US006845959B2

(12) United States Patent
Berckenhoff et al.

(10) Patent No.: US 6,845,959 B2
(45) Date of Patent: Jan. 25, 2005

(54) QUICK RELEASE BLOWOUT PREVENTER BONNET

(75) Inventors: Michael Wayne Berckenhoff, Spring, TX (US); Edward Ryan Hemphill, Houston, TX (US); William Rinehart Holland, Houston, TX (US)

(73) Assignee: Hydril Company, L.P., Houston, TX (US)

( * ) Notice: Subject to any disclaimer, the term of this patent is extended or adjusted under 35 U.S.C. 154(b) by 95 days.

(21) Appl. No.: 10/424,698

(22) Filed: Apr. 28, 2003

(65) Prior Publication Data

US 2004/0021102 A1 Feb. 5, 2004

Related U.S. Application Data

(63) Continuation-in-part of application No. 09/849,819, filed on May 4, 2001, now Pat. No. 6,554,247.

(51) Int. Cl.[7] ..... E21B 33/06

(52) U.S. Cl. ..... 251/1.3; 166/85.4; 277/325

(58) Field of Search ..... 257/1.1, 1.2, 1.3; 277/325; 166/85.4, 84.3

(56) References Cited

U.S. PATENT DOCUMENTS

| | | | | | |
|---|---|---|---|---|---|
| 3,614,111 | A | * | 10/1971 | Regan | 251/1.2 |
| 3,741,296 | A | * | 6/1973 | Murman et al. | 251/1.1 |
| 3,918,478 | A | * | 11/1975 | Le Rouax | 251/1.3 |
| 4,325,534 | A | * | 4/1982 | Roark et al. | 251/1.3 |
| 4,456,062 | A | * | 6/1984 | Roche et al. | 251/1.3 |
| 5,961,094 | A | * | 10/1999 | Van Winkle | 251/1.1 |
| 6,113,061 | A | * | 9/2000 | Van Winkle | 251/1.3 |
| 6,244,359 | B1 | * | 6/2001 | Bridges et al. | 251/1.2 |

* cited by examiner

*Primary Examiner*—John Bastianelli
(74) *Attorney, Agent, or Firm*—Osha & May, L.L.P.

(57) ABSTRACT

A bonnet lock mechanism for a blowout preventer including an angled surface disposed in the blowout preventer, a latching dog having a tapered surface disposed in the bonnet, and a lock actuator operatively coupled to the latching dog. The the lock actuator is adapted to move the latching dog such that the latching dog is in locking engagement with the angled surface of the blowout preventer.

3 Claims, 22 Drawing Sheets

QUICK RELEASE BLOWOUT PREVENTER BONNET

CROSS-REFERENCE TO RELATED APPLICATIONS

This application is a continuation-in-part of U.S. patent application Ser. No. 09/849,819, filed on May 4, 2001, which issued as U.S. Pat. No. 6,554,247 on Apr. 29, 2003. That application is incorporated by reference in its entirety

BACKGROUND OF INVENTION

1. Field of the Invention

The invention relates generally to blowout preventers used in the oil and gas industry. Specifically, the invention relates to a blowout preventer with a novel bonnet securing mechanism.

2. Background Art

Well control is an important aspect of oil and gas exploration. When drilling a well in, for example, oil and gas exploration applications, devices must be put in place to prevent injury to personnel and equipment associated with the drilling activities. One such well control device is known as a blowout preventer ("BOP").

Blowout preventers are generally used to seal a wellbore. For example, drilling wells in oil or gas exploration involves penetrating a variety of subsurface geologic structures, or "layers." Each layer generally comprises a specific geologic composition such as, for example, shale, sandstone, limestone, etc. Each layer may contain trapped fluids or gas at different formation pressures, and the formation pressures increase with increasing depth. The pressure in the wellbore typically is adjusted to at least balance the formation pressure by increasing a density of drilling mud in the wellbore or increasing pump pressure at the surface of the well.

There are occasions during drilling operations when a wellbore may penetrate a layer having a formation pressure substantially higher than the pressure maintained in the wellbore. When this occurs, the well is said to have "taken a kick." The pressure increase associated with the kick is generally produced by an influx of formation fluids (which may be a liquid, a gas, or a combination thereof) into the wellbore. The relatively high pressure kick tends to propagate from a point of entry in the wellbore uphole (from a high pressure region to a low pressure region). If the kick is allowed to reach the surface, drilling fluid, well tools, and other drilling structures may be blown out of the wellbore. These "blowouts" often result in catastrophic destruction of the drilling equipment (including, for example, the drilling rig) and in substantial injury or death of rig personnel.

Because of the risk of blowouts, BOP's are typically installed at the surface or on the sea floor in deep water drilling arrangements so that kicks may be adequately controlled and "circulated out" of the system. BOP's may be activated to effectively seal in a wellbore until active measures can be taken to control the kick. There are several types of BOP's, the most common of which are annular BOP's and ram-type BOP's.

Annular BOP's typically comprise annular elastomer "packers" that may be activated (e.g., inflated) to encapsulate drillpipe and well tools and completely seal the wellbore. A second type of the BOP is the ram-type BOP. Ram-type BOP's typically comprise a body and at least two oppositely disposed bonnets. The bonnets are generally secured to the body about their circumference with, for example, bolts. Alternatively, bonnets may be secured to the body with a hinge and bolts so that the bonnet may be rotated to the side for maintenance access.

Interior of each bonnet is a piston actuated ram. The rams may be either pipe rams (which, when activated, move to engage and surround drillpipe and well tools to seal the wellbore) or shear rams (which, when activated, move to engage and physically shear any drillpipe or well tools in the wellbore). The rams typically are located opposite of each other and, whether pipe rams or shear rams, the rams typically seal against each other proximate a center of the wellbore in order to completely seal the wellbore.

As with any tool used in drilling oil and gas wells, BOP's must be regularly maintained. For example, BOP's comprise high pressure seals between the bonnets and the body of the BOP. The high pressure seals in many instances are elastomer seals. The elastomer seals must be regularly checked to ensure that the elastomer has not been cut, permanently deformed, or deteriorated by, for example, chemical reaction with the drilling fluid in the wellbore. Moreover, it is often desirable to replace pipe rams with shear rams, or vice versa, to provide different well control options. Therefore, it is important that the blowout preventer includes bonnets that are easily removable so that interior components, such as the rams and seals, may be accessed and maintained.

Developing BOP's that are easy to maintain is a difficult task. For example, as previously mentioned, bonnets are typically connected to the BOP body by bolts or a combination of a hinge and bolts. The bolts must be highly torqued in order to maintain a seal between a bonnet door and the BOP body. The seal between the bonnet and the BOP body is generally a face seal, and the seal must be able to withstand the very high pressures present in the wellbore.

As a result, special tools and equipment are necessary to install and remove the bonnet doors and bonnets so that the interior of the BOP body may be accessed. The time required to install and remove the bolts connecting the bonnet doors to the BOP body results in rig downtime, which is both expensive and inefficient. Moreover, substantially large bolts and a nearly complete "bolt circle" around the circumference of the bonnet door are generally required to provide sufficient force to hold the bonnet door against the body of the BOP. The size of the bolts and the bolt circle may increase a "stack height" of the BOP. It is common practice to operate a "stack" of BOPs (where several BOPs are installed in a vertical relationship), and a minimized stack height is desirable in drilling operations.

Several attempts have been made to reduce stack height and the time required to access the interior of the BOP. U.S. Pat. No. 5,655,745 issued to Morrill shows a pressure energized seal carrier that eliminates the face seal between the bonnet door and the BOP body. The BOP shown in the '745 patent enables the use of fewer, smaller bolts in less than a complete bolt circle for securing the bonnet to the body. Moreover, the '745 patent shows that a hinge may be used in place of at least some of the bolts.

U.S. Pat. No. 5,897,094 issued to Brugman et al. discloses an improved BOP door connection that includes upper and lower connector bars for securing bonnets to the BOP. The improved BOP door connection of the '094 patent does not use bolts to secure the bonnets to the BOP and discloses a design that seeks to minimize a stack height of the BOP.

SUMMARY OF INVENTION

In one embodiment, the invention relates to a bonnet lock mechanism for a blowout preventer includes a radial lock, a radial lock displacement device, and at least one lock actuator operatively coupled to the radial lock displacement device. The radial lock is comprised of straight section, and the radial lock displacement device is adapted to radially displace the radial lock to form a locking engagement between a bonnet and a body of the blowout preventer.

In another embodiment, the invention relates to a bonnet lock mechanism for a blowout preventer including an angled surface disposed in the blowout preventer, a latching dog having a tapered surface disposed in the bonnet, and a lock actuator operatively coupled to the latching dog. The the lock actuator is adapted to move the latching dog such that the latching dog is in locking engagement with the angled surface of the blowout preventer.

DETAILED DESCRIPTION

Figure 1:
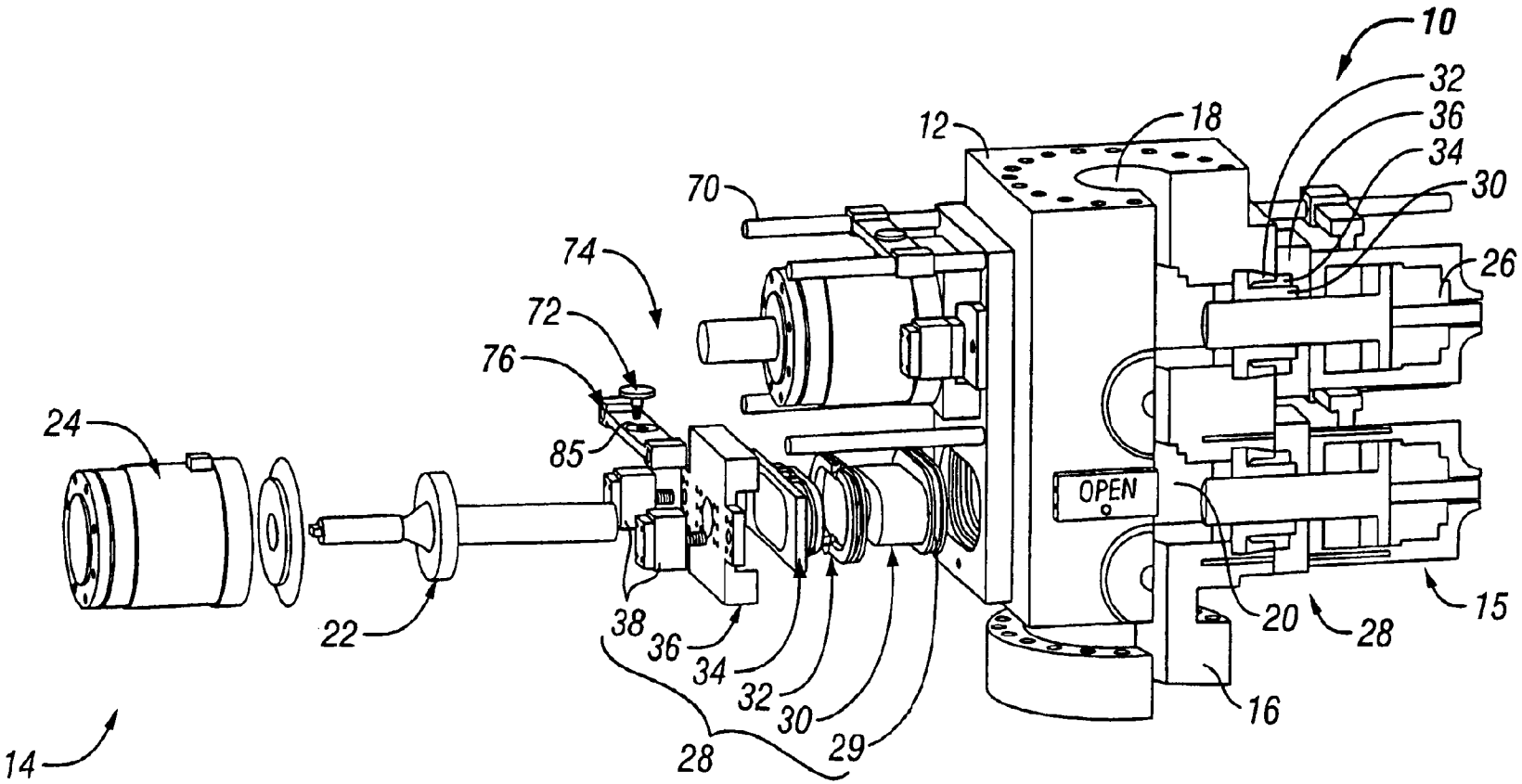
FIG. 1 shows a partial section and exploded view of a BOP comprising an embodiment of the invention.

An embodiment of the invention is shown in FIG. 1. A ram-type blowout preventer (BOP) 10 comprises a BOP body 12 and oppositely disposed bonnet assemblies 14. The BOP body 12 further comprises couplings 16 (which may be, for example, flanges) on an upper surface and a lower surface of the BOP body 12 for coupling the BOP 10 to, another BOP or to a well tool. The BOP body 12 comprises an internal bore 18 therethrough for the passage of drilling fluids, drillpipe, well tools, and the like used to drill, for example, an oil or gas well. The BOP body 12 further comprises a plurality of side passages 20 wherein each of the plurality of side passages 20 is generally adapted to be coupled to a bonnet assembly 14.

The bonnet assemblies 14 are coupled to the BOP body 12, typically in opposing pairs as shown in FIG. 1. Each bonnet assembly 14 further comprises a plurality of components adapted to seal the bonnet assembly 14 to the BOP body 12 and to activate a ram piston 22 within each bonnet assembly 14. Components of the bonnet assemblies 14 comprise passages therethrough for movement of the ram piston 22.

Each bonnet assembly 14 generally comprises similar components. While each bonnet assembly 14 is a separate and distinct part of the BOP 10, the operation and structure of each bonnet assembly 14 is similar. Accordingly, in order to simplify the description of the operation of the BOP 10 and of the bonnet assemblies 14, the components and operation of one bonnet assembly 14 will be described in detail. It should be understood that each bonnet assembly 14 operates in a similar manner and that, for example, opposing bonnet assemblies 14 typically operate in a coordinated manner.

Proceeding with the description of the operation of one bonnet assembly 14, the piston 22 is adapted to be coupled to a ram (not shown) that may be, for example, a pipe ram or a shear ram. Each ram piston 22 is coupled to a ram actuator cylinder 24 that is adapted to displace the ram piston 22 axially within the bonnet assembly 14 in a direction generally perpendicular to an axis of the BOP body 12, the axis of the BOP body 12 being generally defined as a vertical axis of the internal bore 18 (which is generally parallel with respect to a wellbore axis). A ram (not shown) is generally coupled to the ram piston 22, and, if the rams (not shown) are shear rams, the axial displacement of the ram piston 22 generally moves the ram (not shown) into the internal bore 18 and into contact with a corresponding ram (not shown) coupled to a ram piston 22 in a bonnet assembly 14 disposed on an opposite side of the BOP 10.

Alternatively, if the rams (not shown) are pipe rams, axial displacement of the ram piston generally moves the ram (not shown) into the internal bore 18 and into contact with a corresponding ram (not shown) and with drillpipe and/or well tools present in the wellbore. Therefore, activation of the ram actuator cylinder 24 displaces the ram piston 22 and moves the ram (not shown) into a position to block a flow of drilling and/or formation fluid through the internal bore 18 of the BOP body 12 and, in doing so, to form a high pressure seal that prevents fluid flow from passing into or out of the wellbore (not shown).

The ram actuator cylinder 24 further comprises an actuator 26 which may be, for example, a hydraulic actuator. However, other types of actuators are known in the art and may be used with the invention. Note that for purposes of the description of the invention, a "fluid" may be defined as a gas, a liquid, or a combination thereof.

If the ram (not shown) is a pipe ram, activation of the ram piston 22 moves the ram (not shown) into position to seal around drillpipe (not shown) or well tools (not shown) passing through the internal bore 18 in the BOP body 12. Further, if the ram (not shown) is a shear ram, activation of the ram piston 22 moves the ram (not shown) into position to shear any drillpipe (not shown) or well tools (not shown) passing through the internal bore 18 of the BOP body 12 and, therefore, seal the internal bore 18.

Radial Lock Mechanism for Coupling Bonnets to BOPs

An important aspect of a BOP 10 is the mechanism by which the bonnet assemblies 14 are sealed to the body 12. FIG. 1 shows a radial lock mechanism 28 that is designed to provide a high pressure locking mechanism that retains a high pressure radial seal between the bonnet assembly 14 and the BOP body 12. Moreover, the radial lock mechanism 28 is designed to simplify maintenance of the bonnet assembly 14 and the rams (not shown) positioned therein.

In the embodiments shown in the Figures, the side passages 20 and other components of the BOP 10 designed to be engaged therewith and therein are shown as being oval or substantially elliptical in shape. An oval or substantially elliptical shape (e.g., an oval cross-section) helps reduce the stack height of the BOP, thereby minimizing weight, material used, and cost. Other shapes such as circular shapes, however, are also suitable for use with the invention. Accordingly, the scope of the invention should not be limited to the shapes of the embodiments shown in the Figures.

The radial lock mechanism 28 is positioned within the bonnet assembly 14 and within the side passage 20 of the BOP body 12. In this embodiment, the radial lock mechanism 28 comprises a bonnet seal 29 disposed on a bonnet body 30, a radial lock 32, a radial lock displacement device 34, a bonnet door 36, and lock actuators 38. The bonnet seal 29 cooperatively seals the bonnet body 30 to the BOP body 12 proximate the side passage 20. The bonnet seal 29 comprises a high pressure seal that prevents fluids in the internal bore 18 of the BOP body 12 from escaping via the side passage 20. Various embodiments of the bonnet seal 29 will be discussed in detail below.

When the bonnet seal 29 is formed between the bonnet body 30 and the BOP body 12, the bonnet body 30 is in an installed position and is located proximate the BOP body 12 and at least partially within the side passage 20. Because the bonnet seal 29 is a high pressure seal, the radial lock mechanism 28 must be robust and able to withstand very high pressures present in the internal bore 18.

Figure 2:
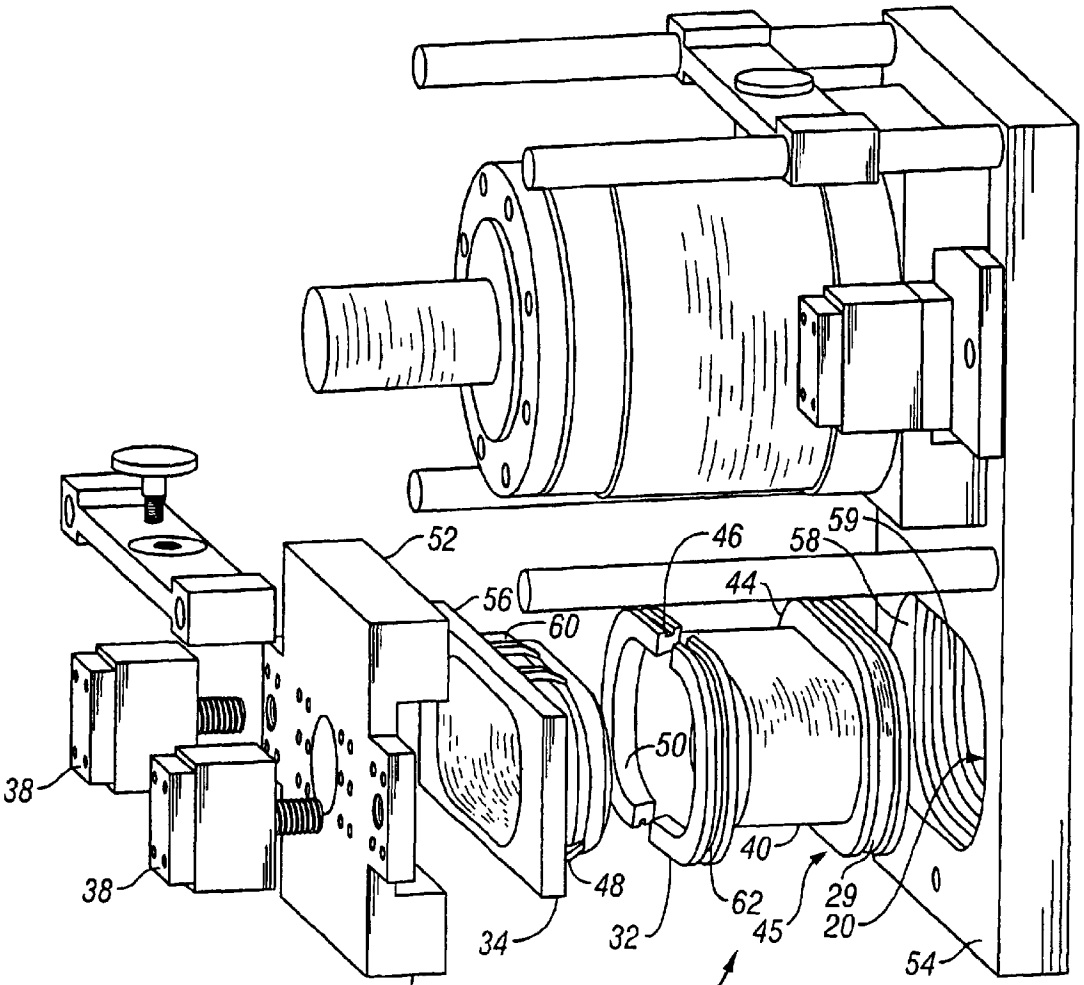
FIG. 2 shows an enlarged view of a portion of the embodiment shown in FIG. 1.

The embodiment shown in FIG. 1 comprises a novel mechanism for locking the bonnet assembly 14 (and, as a result, the bonnet seal 29) in place. Referring to FIG. 2, the radial lock 32 has an inner diameter adapted to fit over an exterior surface 40 of the bonnet body 30 and slide into a position adjacent a sealing end of the bonnet body 30. The radial lock 32 shown in FIG. 2 comprises two halves separated by a center cut 46. However, the radial lock 32 may comprise additional segments and the two segment embodiment shown in FIG. 2 is not intended to limit the scope of the invention. Additional embodiments of the radial lock 32 will be described in greater detail below.

The radial lock displacement device 34 also has an inner diameter adapted to fit over the exterior surface 40 of the bonnet body 30. Moreover, the radial lock displacement device 34 further comprises a wedge surface 48 on an external diameter that is adapted to fit inside an inner diameter 50 of the radial lock 32. The radial lock displacement device 34 also comprises an inner face 56 that is adapted to contact an outer surface 54 of the BOP body 12. In an installed position, the bonnet body 30, the radial lock 32, and the radial lock displacement device 34 are positioned between the BOP body 12 and the bonnet door 36. An inner surface 52 of the bonnet door 36 is adapted to contact the outer surface 54 of the BOP body 12. Note that the engagement between the bonnet door 36 and the BOP body 12 is not fixed (e.g., the bonnet door 36 is not bolted to the BOP body 12).

Referring again to FIG. 1, the bonnet assembly 14 is adapted to slidably engage at least one rod 70 through a swivel slide mount 74 (note that two rods 70 are shown slidably engaged, through the swivel slide mounts 74, with each bonnet assembly 14 in FIG. 1). As a result of the slidable engagement, the bonnet assembly 14 may slide along the rods 70. As will be discussed below, the slidable engagement permits the bonnet assembly 14 to be moved into and out of locking and sealing engagement with the BOP body 12.

The lock actuators 38 are coupled to the bonnet door 36 with either a fixed or removable coupling comprising bolts, adhesive, welds, threaded connections, or similar means known in the art. The lock actuators 38 are also cooperatively coupled to the radial lock displacement device 34 in a similar fashion. Additionally, the coupling between the lock actuators 38 and the radial lock displacement device 34 may be a simple contact engagement. Note that the embodiments in FIG. 1 shows two lock actuators 38 coupled to each bonnet door 36. However, a single lock actuator cylinder 38 or a plurality of lock actuators 38 may be used with the invention. The lock actuators 38 shown are generally hydraulic cylinders; however, other types of lock actuators (including, for example, pneumatic actuators, electrically powered motors, and the like) are known in the art and may be used with the invention.

Moreover, the lock actuators 38 may be manually operated. The lock actuators 38 shown in the present embodiment typically are controlled by, for example, an external electrical signal, a flow of pressurized hydraulic fluid, etc. As an alternative, the radial lock 32 may be activated by manual means, such as, for example, a lever, a system of levers, a threaded actuation device, or other similar means known in the art. Further, if, for example, the lock actuators 38 comprise hydraulic cylinders, the hydraulic cylinders may be activated by a manual pump. Accordingly, manual activation of the radial lock 32 is within the scope of the invention.

A fully assembled view of the bonnet assembly 14 including the radial lock mechanism 28 is shown in FIG. 2. During operation of the radial lock mechanism 28, the bonnet assembly 14 is first moved into position proximate the BOP body 12 by sliding the bonnet assembly 14 toward the BOP body 12 on the rods 70. The lock actuators 38 are then activated so that they axially displace (wherein an axis of displacement corresponds to an axis of the side passage 20) the radial lock displacement device 34 in a direction toward the BOP body 12. As the radial lock displacement device 34 moves axially toward the BOP body 12, the wedge surface 48 contacts the inner diameter 50 of the radial lock 32, thereby moving the radial lock 32 in a radially outward direction (e.g., toward an inner radial lock surface 58 of the side passage 20). When the activation of the radial lock mechanism 28 is complete, an inner nose 60 of the radial lock displacement device 34 is proximate a load shoulder 44 of the bonnet body 30, and an outer perimeter 62 of the radial lock 32 is lockingly engaged with the inner radial lock surface 58. Moreover, as will be described below, both the radial lock 32 and the inner radial lock surface 58 typically comprise angled surfaces (refer to, for example, the engagement surfaces described in the discussion of FIGS. 10 and 11 infra). When the radial lock 32 engages the inner radial lock surface 58, the angled surfaces are designed to provide an axial force that "pulls" the bonnet door 36 in an axially inward direction and firmly against the exterior of the BOP body 12 and thereby completes the locking engagement of the radial lock mechanism 28.

When the radial lock 32 is secured in place by the activation of the lock actuators 38 and the radial lock displacement device 34, the bonnet body 30 and the bonnet assembly 14 are axially locked in place with respect to the BOP body 12 without the use of, for example, bolts. However, an additional manual locking mechanism (not shown) may also be used in combination with the invention to ensure that the radial lock 32 remains securely in place. Once the radial lock 32 is secured in place by, for example, hydraulic actuation, a manual lock (not shown), such as a pinned or threaded mechanism, may be activated as an additional restraint. The secured radial locking mechanism 28 is designed to hold the bonnet assembly 14 and, accordingly, the high pressure bonnet seal 29 in place. The radial lock 32 and the high pressure bonnet seal 29 can withstand the high forces generated by the high pressures present within the internal bore 18 of the BOP body 12 because of the locking engagement between the radial lock 32 and the inner radial lock surface 58 of the BOP body 12.

The radial lock mechanism 28 may be disengaged by reversing the activation of the lock actuators 38 (e.g., after the pressure in the internal bore 18 has been relieved). As a result, the invention comprises a radial lock mechanism 28 that includes a positive disengagement system (e.g., the lock actuators 38 must be activated in order to disengage the radial lock mechanism 28).

Figure 3:
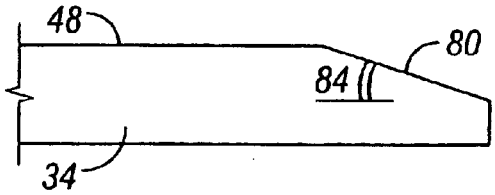
FIG. 3 shows an embodiment of a radial lock displacement device.
Figure 4:
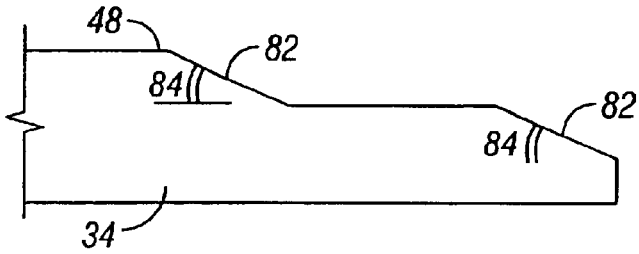
FIG. 4 shows another embodiment of a radial lock displacement device.

The wedge surface 48 used to radially displace the radial lock 32 may comprise any one of several embodiments. Referring to FIG. 3, in one embodiment, the wedge surface 48 of the radial lock displacement device 34 may comprise a single actuation step 80. In another embodiment shown in FIG. 4, the wedge surface 48 may comprise a dual actuation step 82. Note that the single actuation step (80 in FIG. 3) generally has a shorter actuation stroke than the dual actuation step (82 in FIG. 4). Further, an actuation step angle (84 in FIGS. 3 and 4) is designed to maximize a radial actuation force and minimize a linear actuation force. In one embodiment of the invention, the actuation step angle (84 in FIGS. 3 and 4) is approximately 45 degrees. In another embodiment of the invention, the actuation step angle (84 in FIGS. 3 and 4) is less than 45 degrees.

Figure 5:
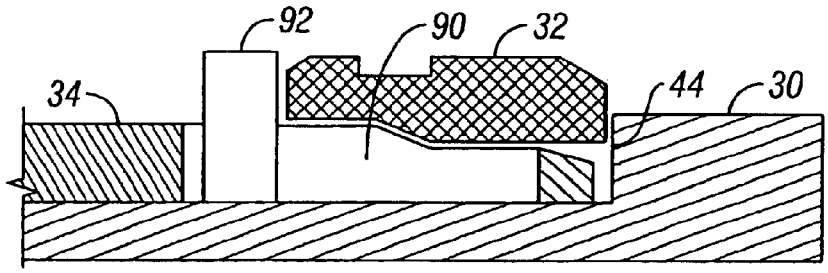
FIG. 5 shows an embodiment of the invention where a radial lock is pinned to a portion of a bonnet.

In another embodiment shown in FIG. 5, the radial lock displacement device 34 further comprises a slot 90 and at least one retention pin 92 designed to retain the radial lock 32 against the load shoulder 44 of the bonnet body 30. In this embodiment, the radial lock 32 is retained in place by the at least one retention pin 92, and the bonnet body 30 and the radial lock 32 are held in a fixed relationship after the radial lock 32 has been actuated and is in locking engagement with the inner radial lock surface (58 in FIG. 2) of the side passage (20 in FIG. 1).

Figure 6:
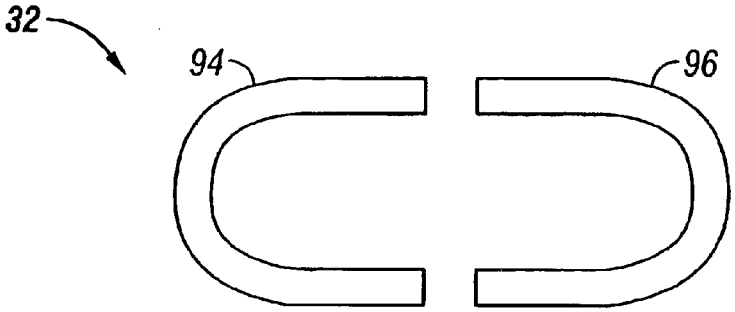
FIG. 6 shows an embodiment of a radial lock comprising two halves.
Figure 7:
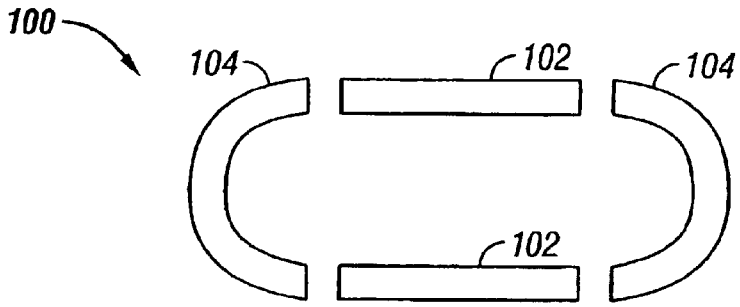
FIG. 7 shows an embodiment of a radial lock comprising four segments.
Figure 8:
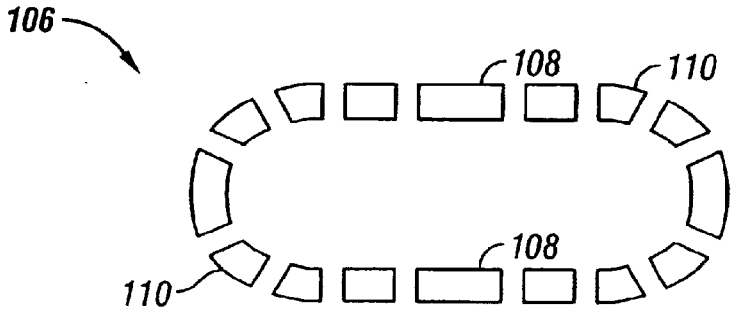
FIG. 8 shows an embodiment of a radial lock comprising a plurality of segments.

The radial lock (32 in FIG. 1) may also comprise any one of several embodiments. The radial lock 32 shown in the embodiment of FIG. 1 comprises two radial mirrored halves 94, 96, as further shown in FIG. 6. In another embodiment, as shown in FIG. 7, a radial lock 100 may be formed from at least two substantially linear segments 102 and at least two semicircular end segments 104. In another embodiment, as shown in FIG. 8, a radial lock 106 may be formed from a plurality of substantially straight dogs 108 and a plurality of curved dogs 110. The embodiments shown in FIGS. 7 and 8 essentially comprise radial locks 100, 106 similar to the radial lock (32 in FIGS. 1 and 6) of the first embodiment but divided into a plurality of segments. The radial locks 100, 106 could be manufactured by, for example, manufacturing a solid radial lock and sequentially saw cutting the solid radial lock into two or more segments. However, other manufacturing techniques are known in the art and may be used to manufacture the radial lock.

Figure 9:
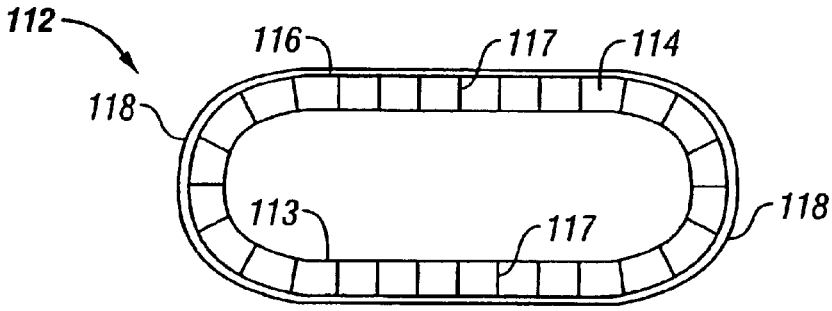
FIG. 9 shows an embodiment of a notched serpentine radial lock.

In another embodiment shown in FIG. 9, a radial lock 112 may be formed from a notched serpentine structure 114 similar to a "serpentine belt." The radial lock 112 is formed, for example, as a single solid piece and then cut 117 through an inner perimeter 114 or an outer perimeter 116. The cuts 117 can either completely transect the radial lock 112 or may include only partial cuts. Further, if the cuts 117 transect the radial lock 112, the individual segments can be attached to a flexible band 118 so that the radial lock 112 can be actuated with an actuating ring (34 in FIG. 1). The flexible band 118 may comprise a material with a relatively low elastic modulus (when compared to, for example, the elastic modulus of the individual segments) so that the flexible band 118 can radially expand in response to the radial displacement produced by the radial lock displacement device (34 in FIG. 1). Radial expansion of the flexible band 118 results in a locking engagement between the radial lock 112 and the inner radial lock surface (58 in FIG. 2) of the BOP body (12 in FIG. 1).

Figure 10:
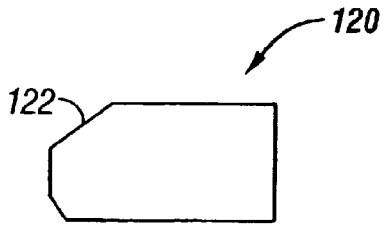
FIG. 10 shows an embodiment of a locking mechanism used in an embodiment of the invention.

The engagement between the radial lock (32 in FIG. 1) and the inner radial lock surface (58 in FIG. 2) may also comprise different embodiments. In one embodiment, as shown in FIG. 10, a radial lock 120 may comprise a single profile engagement including a single radial lock engagement surface 122. The single radial lock engagement surface 122 is designed to lockingly engage a BOP engagement surface (59 in FIG. 2) formed on the inner radial lock surface (58 in FIG. 2) of the side passage (20 in FIG. 1).

Figure 11:
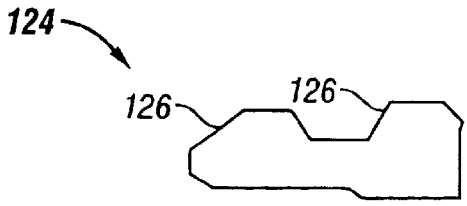
FIG. 11 shows an embodiment of a locking mechanism used in an embodiment of the invention.

In another embodiment, as shown in FIG. 11, a radial lock 124 comprises a dual profile engagement including two radial lock engagement surfaces 126. Moreover, the radial lock 124 may also comprise a plurality of radial lock engagement surfaces designed to lockingly engage a corresponding number of BOP engagement surfaces (59 in FIG. 2) formed on the inner radial lock surface (58 in FIG. 2) of the side passage (20 in FIG. 1) of the BOP body (12 in FIG. 1).

The radial locks described in the referenced embodiments are designed so that the cross-sectional area of engagement between the radial lock engagement surfaces with the BOP engagement surfaces (59 in FIG. 2) is maximized. Maximizing the cross-sectional areas of engagement ensures that the radial locks positively lock the bonnet assembly (14 in FIG. 1) and, as a result, the bonnet seal (29 in FIG. 1) in place against the high pressures present in the internal bore (18 in FIG. 1) of the BOP (10 in FIG. 1). Moreover, as discussed previously, angles of the engagement surfaces may be designed to produce an axial force that firmly pulls the bonnet door (36 in FIG. 1) against the BOP body (12 in FIG. 1) and that in some embodiments may assist in the activation of the bonnet seal (29 in FIG. 1).

The radial locks and the engagement surfaces described in the foregoing embodiments may be coated with, for example, hardfacing materials and/or friction reducing materials. The coatings may help prevent, for example, galling, and may prevent the radial locks from sticking or "hanging-up" in the engagement surfaces during the activation and/or deactivation of the radial lock mechanism (28 in FIG. 1). The coatings may also increase the life of the radial locks and the engagement surfaces by reducing friction and wear.

Figure 12:
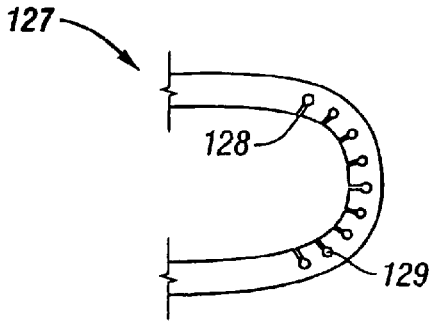
FIG. 12 shows an embodiment of a locking mechanism used in an embodiment of the invention.

Another embodiment of the lock ring is shown at 127 in FIG. 12. The radial lock 127 comprises a plurality of saw cuts 128, a plurality of holes 129, or a combination thereof. The saw cuts 128 and/or holes 129 decrease the weight and area moment of inertia of the radial lock 127, thereby reducing the actuation force required to radially displace the radial lock 127. In order to permit some elastic deformation of the radial lock 127, the radial lock 127 may be formed from a material having a relatively low modulus of elasticity (when compared to, for example, steel). Such materials comprise titanium, beryllium copper, etc. Moreover, modifications to the radial lock 127 geometry, in addition to those referenced above, may be made to, for example, further reduce the area moment of inertia of the radial lock 127 and reduce bending stresses.

The radial locks described above are designed to operate below an elastic limit of the materials from which they are formed. Operation below the elastic limit ensures that the radial locks will not permanently deform and, as a result of the permanent deformation, lose effectiveness. Accordingly, material selection and cross-sectional area of engagement of the engagement surfaces is very important to the design of the radial lock mechanism (28 in FIG. 1).

Referring to FIG. 1, the bonnet seal 29 is designed to withstand the high pressures present in the internal bore 18 of the BOP body 12 and to thereby prevent fluids and/or gases from passing from the internal bore 18 to the exterior of the BOP 10. The bonnet seal 29 may comprise several different configurations as shown in the following discussion of FIGS. 13–17. Moreover, the seals disclosed in the discussion below may be formed from a variety of materials. For example, the seals may be elastomer seals or non-elastomer seals (such as, for example, metal seals, PEEK seals, etc.). Metal seals may further comprise metal-to-metal C-ring seals and/or metal-to-metal lip seals. Further, the sealing arrangements shown below may include a combination of seal types and materials. Accordingly, the type of seal, number of seals, and the material used to form radial and face seals are not intended to limit the bonnet seal 29.

Figure 13:
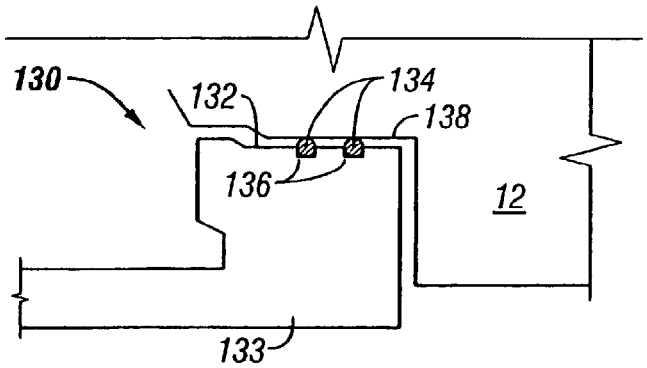
FIG. 13 shows an embodiment of a high pressure seal used in an embodiment of the invention.

The embodiment in FIG. 13 comprises a bonnet seal 130 formed on a radial perimeter 132 of a bonnet body 133. The radial seal 130 further comprises two o-rings 134 disposed in grooves 136 formed on the radial perimeter 132 of the bonnet body 133. The o-rings 134 sealingly engage an inner sealing perimeter 138 of the side passage (20 in FIG. 1) in the BOP body 12. The embodiment shown in FIG. 13 comprises two grooves 136, but a single groove or a plurality of grooves may be suitable for use with the o-rings 134. Moreover, while the embodiment shows two o-rings 134, a single o-ring or more than two o-rings may be used in the invention.

Figure 14:
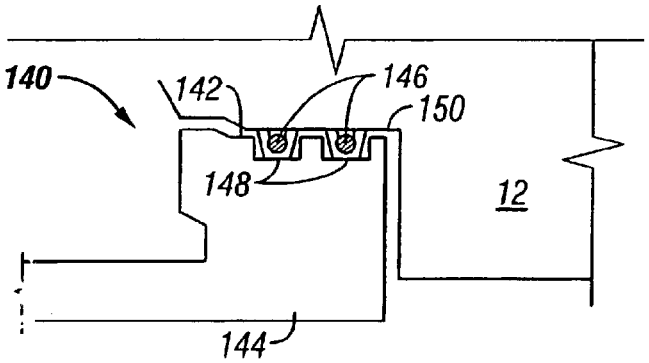
FIG. 14 shows an embodiment of a high pressure seal used in an embodiment of the invention.

In another embodiment shown in FIG. 14, a bonnet seal 140 comprises at least two packing seals 146 (which may be, for example, t-seals, lip seals, or seals sold under the trademark PolyPak, which is a mark of Parker Hannifin, Inc.) disposed in grooves 148 formed on a radial perimeter 142 of a bonnet body 144. The packing seals 146 sealingly engage an inner sealing perimeter 150 of the side passage (20 in FIG. 1) of the BOP body 12. The embodiment shown in FIG. 14 comprises two grooves 148, but a single groove or a plurality of grooves may be suitable for use with the packing seals 146. Moreover, while the embodiment shows two packing seals 146, a single seal or more than two seals may be used in the invention.

Figure 15:
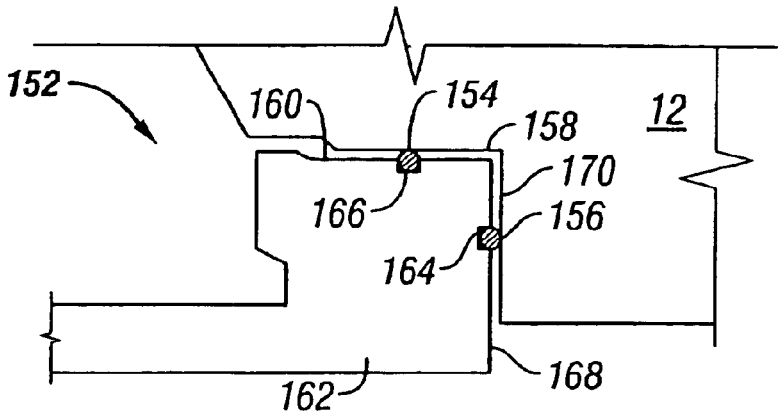
FIG. 15 shows an embodiment of a high pressure seal used in an embodiment of the invention.

In another embodiment shown in FIG. 15, the bonnet seal 152 comprises a radial seal 154 disposed in a groove 166 formed on a radial perimeter 160 of a bonnet body 162. Moreover, the embodiment comprises a face seal 156 disposed in a groove 164 formed on a mating face surface 168 of the bonnet body 162. The radial seal 154 is adapted to sealingly engage an inner sealing perimeter 158 of the side passage (20 in FIG. 1) of the BOP body 12. The face seal 156 is adapted to sealingly engage an exterior face 170 of the BOP body 12. The radial seal 154 and face seal 156 shown in the embodiment are both o-rings and are disposed in single grooves 166, 164. However, a different type of seal (such as, for example, a packing seal) and more than one seal (disposed in at least one groove) may be used with the invention.

Figure 16:
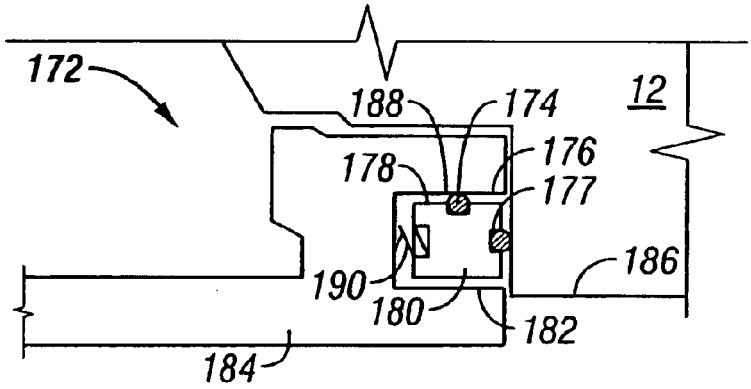
FIG. 16 shows an embodiment of a high pressure seal used in an embodiment of the invention.

In another embodiment shown in FIG. 16, the bonnet seal 172 comprises a radial seal 174 disposed in a groove 178 formed on a seal carrier 180. The seal carrier 180 is disposed in a groove 182 formed in a bonnet body 184 and also comprises a face seal 176 disposed in a groove 177 formed on the seal carrier 180. The face seal 176 is adapted to sealingly engage mating face surface 186 of the BOP body 12, and the radial seal is adapted to sealingly engage an inner sealing perimeter 188 formed on the bonnet body 184. The bonnet seal 172 may also comprise an energizing mechanism 190 that is adapted to displace the seal carrier 180 in a direction toward the exterior surface 186 of the BOP body 12 so as to energize the face seal 176. The energizing mechanism 190 may comprise, for example, a spring, a thrust washer, or a similar structure.

The energizing mechanism 190 helps ensure that the face seal 176 maintains positive contact with and, thus, maintains a high pressure seal with the exterior surface 186 of the BOP body 12. However, the energizing mechanism 190 is not required in all embodiments. For example, the seal carrier 180 may be designed so that both the radial seal 174 and the face seal 176 are pressure activated without the assistance of an energizing mechanism 190.

In the embodiment without an energizing mechanism, a diameter and an axial thickness of a seal carrier (such as the seal carrier 180 shown in FIG. 16) are selected so that high pressure from the internal bore first moves the seal carrier toward the exterior surface of the BOP body. Once the face seal sealingly engages the exterior surface, the high pressure from the internal bore causes the seal carrier to radially expand until the radial seal sealingly engages the groove in the seal carrier. A similar design is disclosed in U.S. Pat. No. 5,255,890 issued to Morrill and assigned to the assignee of the present invention. The '890 patent clearly describes the geometry required for such a seal carrier.

In the embodiment shown in FIG. 16, the face seal 176 and the radial seal 174 may be, for example, o-rings, packing seals, or any other high pressure seal known in the art. Moreover, FIG. 16 only shows single seals disposed in single grooves. However, more than one seal, more than one groove, or a combination thereof may be used with the invention.

Figure 17:
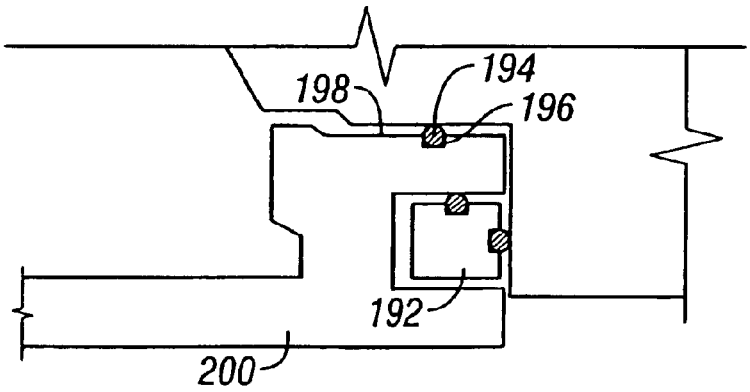
FIG. 17 shows an embodiment of a high pressure seal used in an embodiment of the invention.

In another embodiment shown in FIG. 17, the seal carrier 192 as shown in the previous embodiment is used in combination with a backup seal 194 disposed in a groove 196 on an external surface 198 of a bonnet body 200. The backup seal 194 may be an o-ring, a packing seal, a metal seal, or any other high pressure seal known in the art. The backup seal 194 further maintains a high pressure seal if, for example, there is leakage from the seals disposed on the seal carrier 192. Note that the embodiment shown in FIG. 17 does not include an energizing mechanism.

Advantageously, some of the seal embodiments reduce an axial force necessary to form the bonnet seal. The bonnet seals shown above greatly reduce the sensitivity of the bonnet seal to door flex by maintaining a constant squeeze regardless of wellbore pressure. The radial seal arrangements also reduce the total area upon which wellbore pressure acts and thus reduces a separation force that acts to push the bonnet door away from the BOP body.

Figure 18:
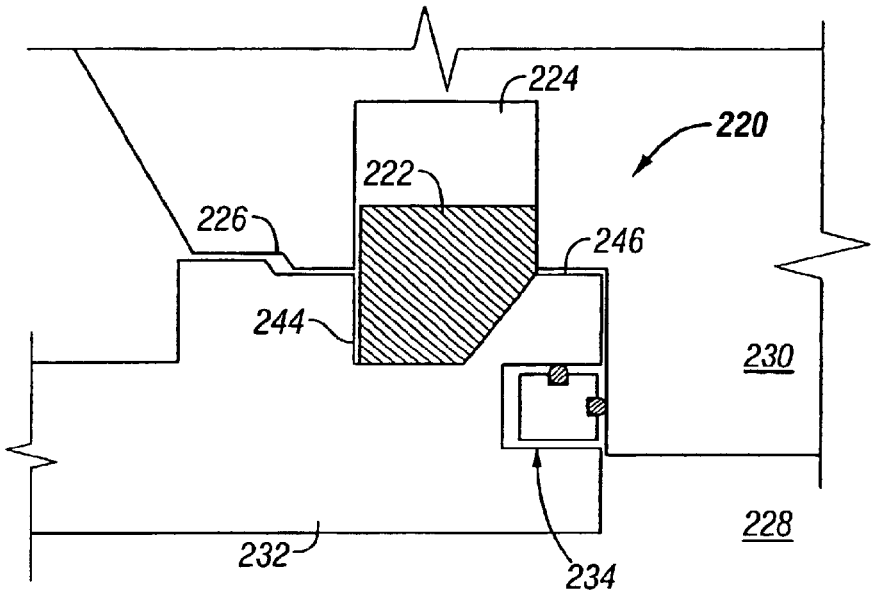
FIG. 18 shows an embodiment of the invention wherein a radial lock is disposed in a recess in a side passage of a BOP body.

In another embodiment of the radial lock shown in FIG. 18, the radial lock mechanism 220 comprises a radial lock 222 disposed in a recess 224 formed on an internal surface 226 of a side passage 228 of a BOP body 230. The operation of the radial lock mechanism 220 differs from the embodiments described above in that securing a bonnet body 232 and, accordingly, a bonnet door (not shown) and a bonnet assembly (not shown), in place is accomplished by actuating the radial lock mechanism 220 in radially inward direction.

The structure of the embodiment shown in FIG. 18 is similar to the structure of the embodiments described above except for the direction of actuation of the radial lock mechanism 220. Therefore, the discussion of the present embodiment will include a description of how the alternative radial lock mechanism 220 differs from those shown above. Common elements of the embodiments (such as, for example, the bonnet door 36, the linear rods 70, etc.) will not be described again in detail. Moreover, it should be noted that the embodiment of FIG. 18 does not require, for example, actuator cylinders or a radial lock displacement device (e.g., the embodiment of FIG. 18 does not require an internal actuation mechanism).

Figure 19:
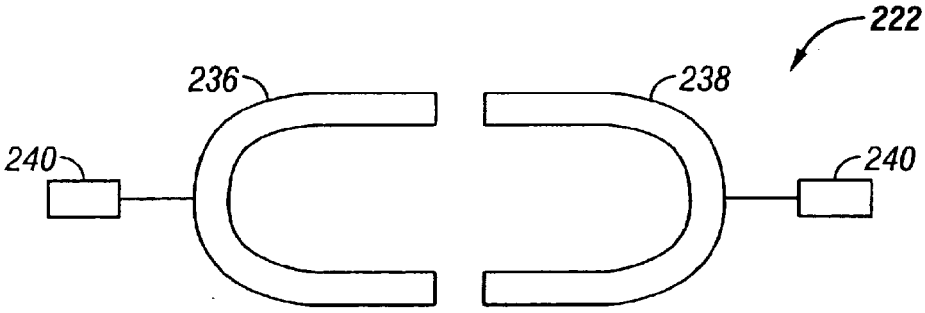
FIG. 19 shows an embodiment of a radial lock comprising two halves.

Actuation of the radial lock 222 is in a radially inward direction. Accordingly, the radial lock 222 must be coupled to an actuation mechanism that differs from, for example, the radial lock displacement device (34 in FIG. 1) and the lock actuators (38 in FIG. 1) described in the previous embodiments. In one embodiment of the invention, the radial lock 222 comprises a structure similar to those shown in FIGS. 6 and 7. As shown in FIG. 19, separate halves 236, 238 of the radial lock 222 may be coupled to radially positioned actuators 240. When the bonnet body 232 is moved into a sealing engagement with the BOP body 230, the actuators 240 are activated to displace the halves 236, 238 of the radial lock 222 in a radially inward direction so that the radial lock 222 engages a groove (244 in FIG. 18) formed on an exterior surface (246 in FIG. 18) of the bonnet body (232 in FIG. 18). The radial lock mechanism (220 in FIG. 18) locks the bonnet body (232 in FIG. 18) and, therefore, the bonnet door (not shown) and the bonnet assembly (not shown) in place and energizes the high pressure seal (234 in FIG. 18). Note that the high pressure seal (234 in FIG. 18) may be formed from any of the embodiments shown above (such as the embodiments described with respect to FIGS. 13–17). Moreover, the radial lock 222 and the groove 244 may comprise angled surfaces (as disclosed in previous embodiments) that produce an axial force that pulls the bonnet body 232 (and the bonnet assembly (not shown) and bonnet door (not shown)) toward the BOP body 230 and further ensure a positive locking engagement.

Figure 20:
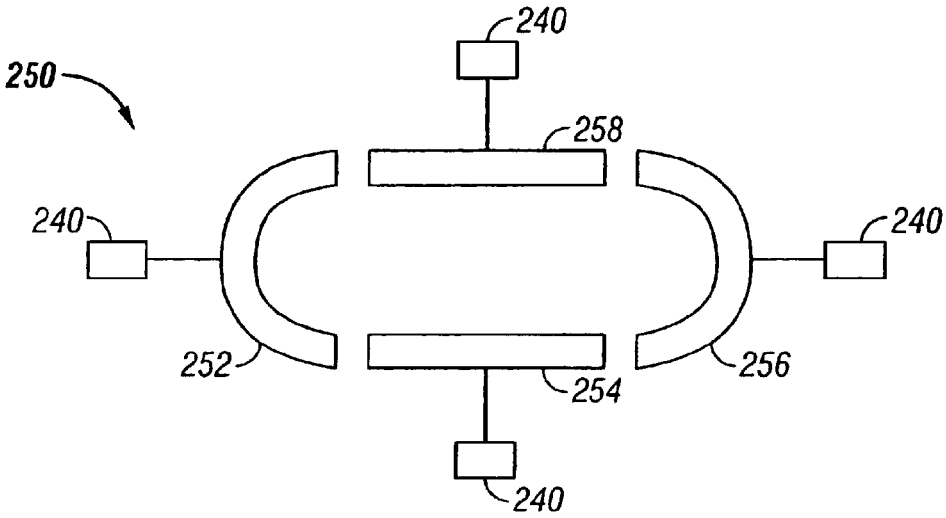
FIG. 20 shows an embodiment of a radial lock comprising four segments.

Moreover, as shown in FIG. 20, the radial lock 222 may comprise more than two parts. If a radial lock 250 comprises, for example, four parts 252, 254, 256, 258, an equal number of actuators 240 (e.g., four) may be used to actuate the radial lock 250. Alternatively, fewer actuators 240 (e.g., less than four in the embodiment shown in FIG. 20) may be used if an actuator 240 is, for example, coupled to more than one part parts 252, 254, 256, 258 of the radial lock 250. The actuators 240 may be hydraulic actuators or any other type of actuator known in the art. Moreover, the actuators 240 may be disposed within the BOP body (230 in FIG. 18) or may be positioned external to the BOP body (230 in FIG. 18). The actuators 240 may be coupled to the radial lock 250 with, for example, mechanical or hydraulic linkages (not shown). On another embodiment, the radial lock 222 comprises a plurality of dies or dogs (not shown) that are coupled to and activated by a plurality of actuators (not shown).

Figure 21:
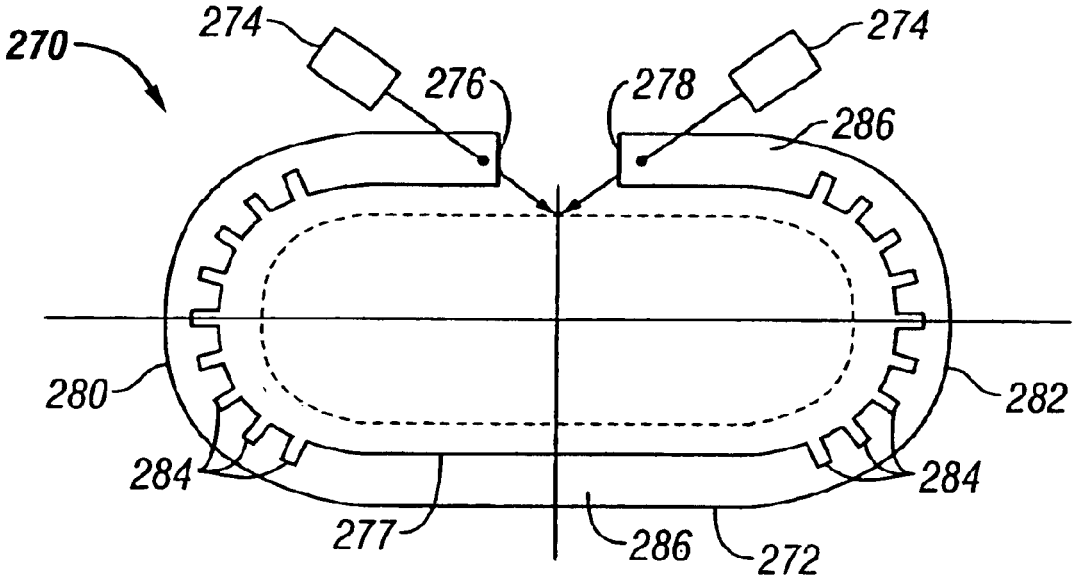
FIG. 21 shows an embodiment of a radial lock comprising a plurality of kerfs.

In another embodiment of the invention shown in FIG. 21, a radial lock 270 may be formed from a single segment 272. The radial lock 270 is actuated by circumferential actuators 274 coupled to the radial lock 270 and disposed proximate ends 276, 278 of the segment 272. When activated, the circumferential actuators 274 move the ends 276, 278 of the segment 272 towards each other and in a radially inward direction as shown by the arrows in FIG. 21. The dashed line in FIG. 21 represents an inner surface 277 of the radial lock 270 after actuation. The radial lock 270, when actuated, engages the bonnet body (232 in FIG. 18) in a manner similar to that shown in FIG. 18.

Figure 22:
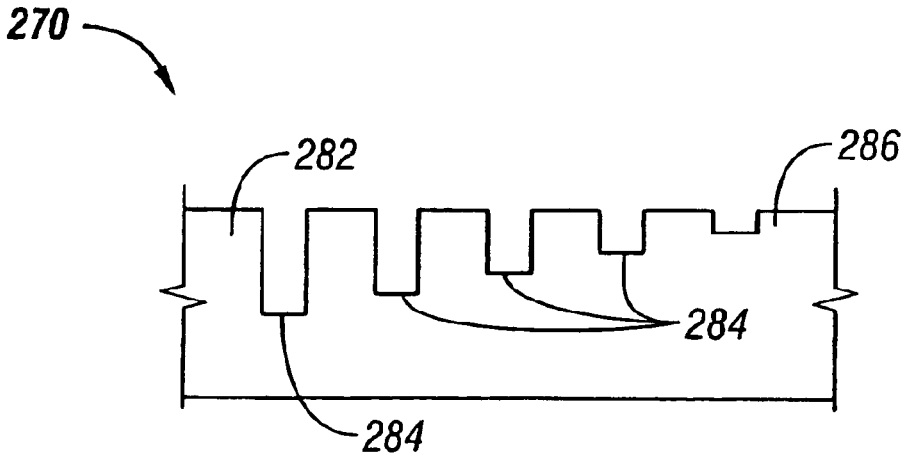
FIG. 22 shows an embodiment of a radial lock comprising graduated kerfs.

The segment 272 of the radial lock 270 may be produced by forming a plurality of kerfs 284 proximate the end segments 280, 282. The kerfs 284 may be designed to ease installation of the radial lock 270 in the recess (224 in FIG. 18) and to improve flexibility for radial deformation of the radial lock 270. The kerfs may be of any shape known in the art. For example, FIG. 22 shows rectangular kerfs 284. However, the kerfs 284 may preferably be formed in a manner that reduces stress concentrations or stress risers at the edges of the kerfs 284. For example, if the kerfs 284 are formed as rectangular shapes, stress risers may form at the relatively sharp corners. Accordingly, the kerfs 284 may comprise filleted corners (not shown) or, for example, substantially trapezoidal shapes (not shown) to minimize the effects of stress risers.

Moreover, the kerfs 284 may be "graduated," as shown in FIG. 22, to produce a substantially smooth transition between relatively stiff straight segments 286 and relatively flexible end segments 280, 282. Graduation of the kerfs 284 effects a smooth stiffness transition that helps prevent stress risers at the last kerf (e.g., at the last kerf proximate the straight segments 286).

The radial lock 270 may be formed from a single material or from different materials (comprising, for example, steel, titanium, beryllium copper, or combinations and/or alloys thereof). For example, the curved end segments 280, 282 may be formed from a material that is relatively compliant when compared to a relatively rigid material forming the straight segments 286 (e.g., the curved and segments 280, 282 may be formed from a material with an elastic modulus ($E_C$) that is substantially lower than an elastic modulus ($E_S$) of the straight segments 286). Regardless of the materials used to form the radial lock 270, the radial lock 270 must be flexible enough to permit installation into and removal from the recess (224 in FIG. 18).

Alternatively, the radial lock 270 of FIG. 21 may comprise more than one segment (e.g., two halves or a plurality of segments) coupled to and actuated by a plurality of circumferential actuators. The radial lock 270 may also comprise a plurality of separate dies or dogs coupled by a flexible band. The dies may be separated by gaps, and the distance of separation may be selected to provide a desired flexibility for the radial lock 270.

The dies and the flexible banding may comprise different materials. For example, the dies may be formed from a substantially stiff material (e.g., a material with a relatively high modulus of elasticity) comprising, for example, steel or nickel based alloys. The flexible banding, in contrast, may be formed from materials having a relatively lower modulus elasticity and comprising, for example, titanium alloys or pultruded flats or shapes comprising fiberglass, carbon fibers, or composite materials thereof. As described above, the radial locks of the embodiments shown in FIGS. 19–22 may be coated with, for example, hardfacing materials (comprising, for example, tungsten carbide, boron nitride, and similar materials known in the art) or low-friction materials (comprising, for example, polytetrafluoroethylene and similar materials known in the art) to, for example, reduce friction and wear and improve the longevity of the parts. The material composition of the radial lock 270 is not intended to be limiting.

The embodiments shown in FIGS. 19–22 may be advantageous because of a reduced bonnet assembly weight and accordingly, reduced overall weight of the BOP. Moreover, there is a potential to retrofit old BOPs to include the radial lock mechanism.

Swivel Slide Mount for Bonnet Assemblies

Referring again to FIG. 1, another important aspect of the invention is the swivel slide mounts 74 cooperatively attached to the rods 70 and to each of the bonnet assemblies 14. As described previously herein, the bonnet assemblies 14 are coupled to the swivel slide mounts 74, and the swivel slide mounts 74 are slidably engaged with the rods 70. The swivel slide mounts 74 are adapted to allow the bonnet assemblies 14 to rotate proximate their axial centerlines so that the rams (not shown) and the interior components of both the bonnet assemblies 14 and the BOP body 12 may be accessed for maintenance, to change the rams, etc.

Figure 23:
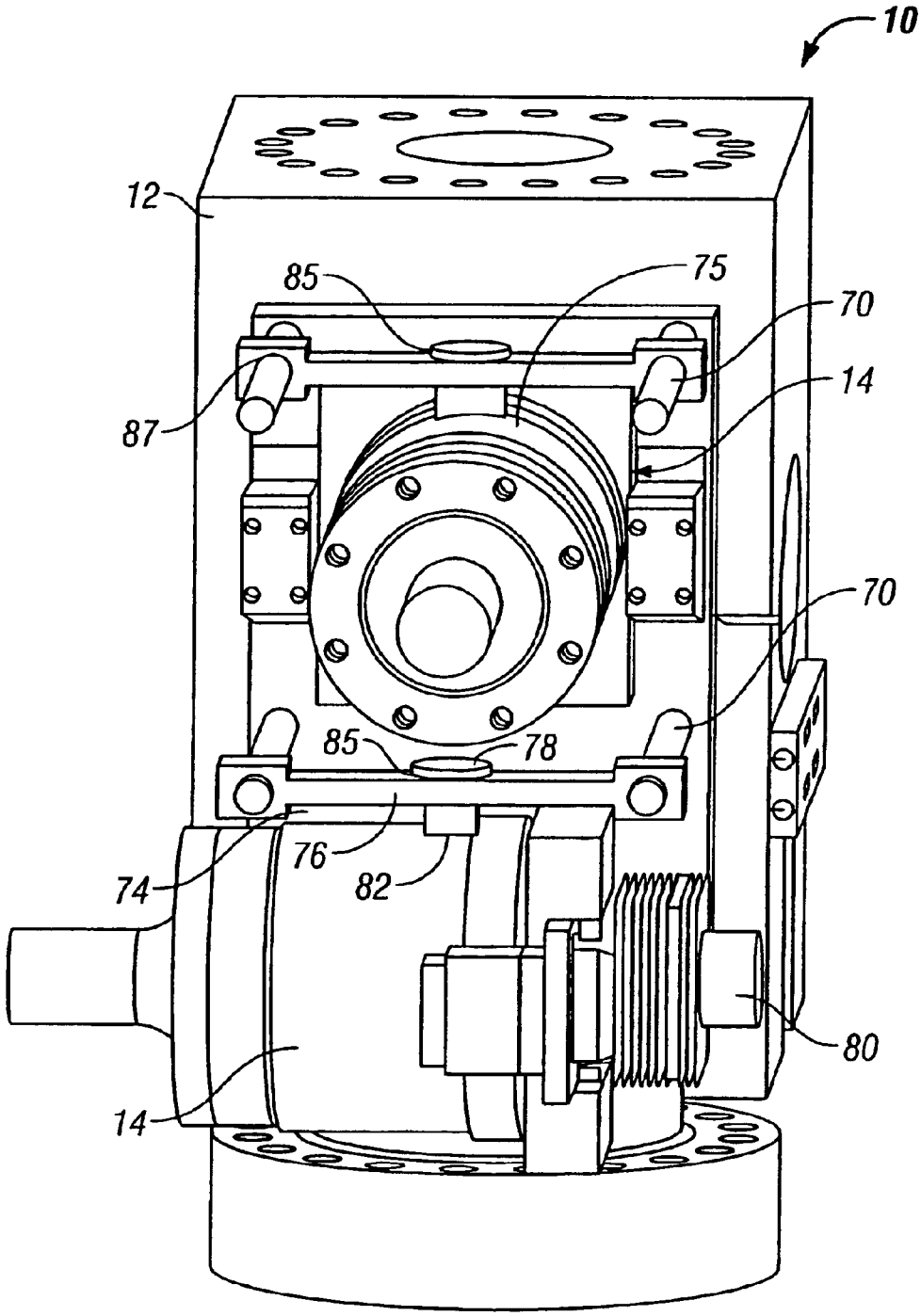
FIG. 23 shows a side perspective view of an embodiment of a swivel slide mount used in an embodiment of the invention.
Figure 24:
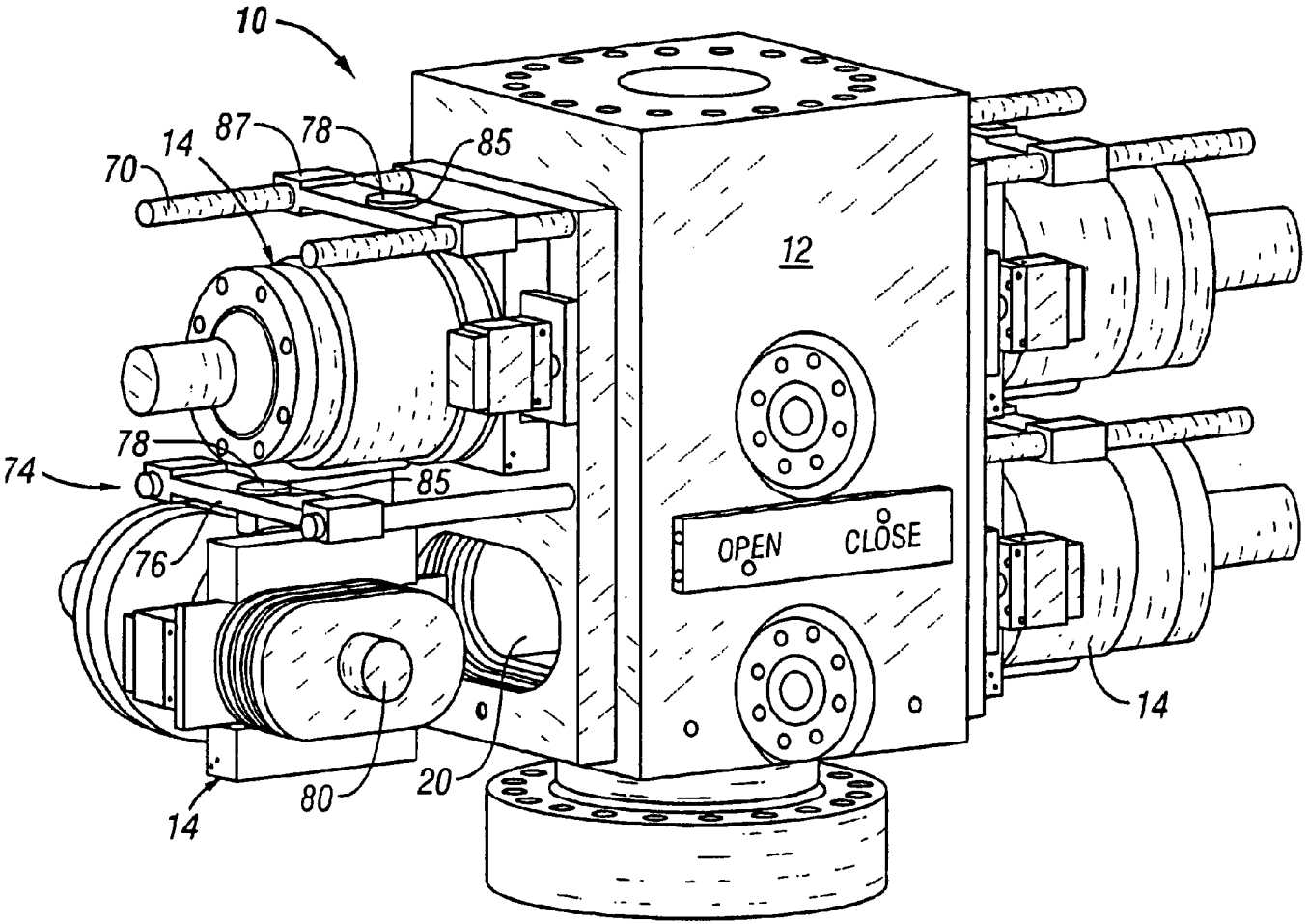
FIG. 24 shows a front perspective view of an embodiment of a swivel slide mount used in an embodiment of the invention.

An embodiment of the swivel slide mount 74 is shown in FIGS. 23 and 24. The swivel slide mount 74 comprises a swivel slide mounting bar 76 and a swivel plate 78. The swivel slide mounting bar 76 is slidably attached to the rods 70. The slidable attachment between the swivel slide mounting bar 76 and the rods 70 may be made with, for example, linear bearings 87 that are coupled to the swivel slide mounting bar 76. However, other slidable attachments known in the art may be used with the invention to form the slideable attachment. Moreover, bushings (not shown), or a combination of linear bearings 87 and bushings (not shown) may be used with the invention. The swivel plate 78 is rotationally attached to the swivel slide mounting bar 76 and is cooperatively attached to an upper surface 75 of the bonnet assembly 14. The cooperative attachment of the swivel slide mount 74 to the bonnet assembly 14 is made substantially at an axial centerline of the bonnet assembly 14.

The rods 70 are designed to be of sufficient length to permit the bonnet assembly 14 to disengage from the BOP body 12 and slide away from the BOP body 12 until the ram (not shown) is completely outside the side passage 20. Moreover, a point of attachment 82 where the swivel slide mount 74 is cooperatively attached to the upper surface 75 of the bonnet assembly 14 may be optimized so that the point of attachment 82 is substantially near a center of mass of the bonnet assembly 14. Positioning the point of attachment 82 substantially near the center of mass reduces the force required to rotate the bonnet assembly 14 and also reduces the bending stress experienced by the swivel plate 78.

The swivel plate 78 may further include a bearing 85. For example, the bearing 85 may be cooperatively attached to the swivel slide mounting bar 76 and adapted to withstand both radial and thrust loads generated by the rotation of the bonnet assembly 14. The bearing 85 may comprise, for example, a combination radial bearing and thrust bearing (such as, for example, a tapered roller bearing). Alternatively, the bearing 85 may comprise, for example, a roller bearing to support radial loads and a thrust washer to support axial loads. However, other types of bearing arrangements are known in the art and may be used with the swivel plate 78.

When the ram (not shown) is completely out of the side passage 20, the bonnet assembly 14 can rotate about a rotational axis of the swivel plate 78 so that the ram (not shown) and the side passage 20 may be accessed for maintenance, inspection, and the like. In the embodiment shown in FIGS. 23 and 24, the lower bonnet assembly 14 is shown to be rotated approximately 90 degrees with respect to the BOP body 12 while the upper bonnet assembly 14 remains in locking engagement with the BOP body 12. A ram block attachment point 80 is clearly visible.

Figure 25:
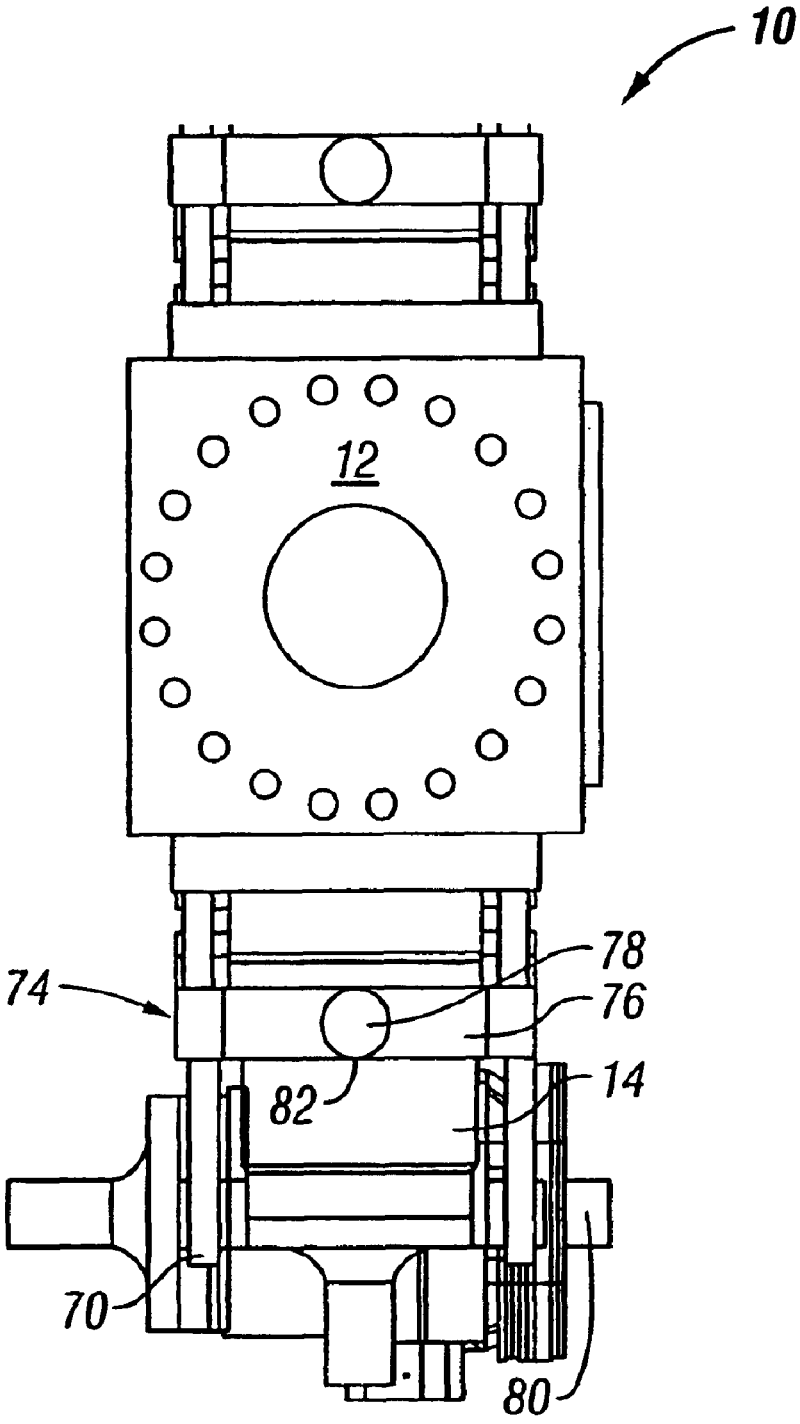
FIG. 25 shows a top perspective view of an embodiment of a swivel slide mount used in an embodiment of the invention.

FIG. 25 shows a top view of the BOP 10 when one of the bonnet assemblies 14 has been disengaged from the BOP body 12 and rotated approximately 90 degrees. As shown, the ram block attachment point 80 is clearly visible and may be vertically accessed. Vertical access is a significant advantage because prior art bonnets that include hinges generally pivot about an edge of the bonnet door. Therefore, if, for example, a lower BOP bonnet was unbolted and pivoted open, the ram could not be vertically accessed because the body of the upper BOP bonnet was in the way. Vertical access to the ram is important because it makes it much easier to maintain or replace rams, thus reducing the time required to maintain the BOP and increasing the level of safety of the personnel performing the maintenance. Further, vertical access enables, for example, maintenance of a lower BOP bonnet while an upper bonnet is locked in position (see, for example, FIGS. 23–25).

The bonnet assembly 14 may also be rotated approximately 90 degrees in the other direction with respect to an axis of the side passage (20 in FIG. 1), thereby permitting approximately 180 degrees of rotation. However, other embodiment may be designed that permit rotation of greater than or less than 180 degrees. The range of rotation of the swivel slide mount 74 is not intended to limit the scope of the invention.

The swivel slide mount 74 is advantageous because of the simplicity of the design and attachment to the bonnet assembly 14. For example, prior art hinges are generally complex, difficult to manufacture, and relatively expensive. Further, prior art hinges have to be robust because they carry the full weight of the BOP bonnet about a vertical axis positioned some distance away from the center of mass of the bonnet. The bending moment exerted on the hinge is, as a result, very high and deformation of the hinge can lead to "sagging" of the bonnet.

Other Mechanisms for Coupling Bonnets to BOPs

FIGS. 26–37B show other embodiments of latching mechanisms for latching a bonnet to BOP body. The embodiments described are only provided as examples of latching mechanisms that can be used in accordance with the invention. The invention is not limited by any one mechanism.

Figure 26:
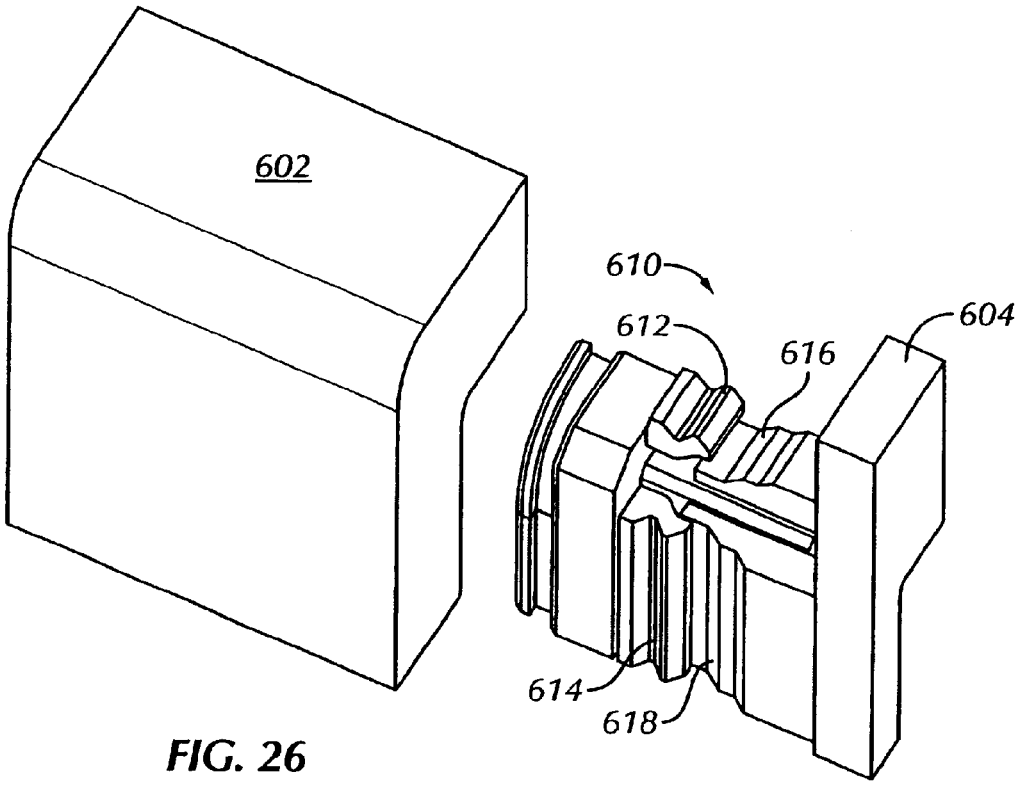
FIG. 26 shows a perspective view of one embodiment of a bonnet latching mechanism.

FIG. 26 shows a cutaway of one embodiment of a latch mechanism 610. A BOP body 602 and a bonnet 604 are held securely together by latch mechanism 610. The mechanism 610 includes a radial lock 612, 614 and a radial lock displacement device 616, 618, similar to those described above. The radial lock, in this embodiment, comprises only straight sections 612, 614. A first straight section 612 extends horizontally and a second straight section 614 extends vertically. It is understood that in some embodiments two additional straight sections, one horizontal and one vertical, may be positioned on sides of the bonnet 604 that are not shown in the cutaway of FIG. 26.

The radial lock displacement also comprises a horizontal section 616 and a vertical section 618 that radially displace the horizontal and vertical sections 612, 614 of the radial lock. It is understood that in some embodiments another horizontal and another vertical section (not shown) may be used on the sides of the bonnet 604 not shown in FIG. 26.

In the embodiment shown in FIG. 26, the radial lock has no curved (or radial) sections. Only straight sections 612, 614 are displaced into locking engagement with a corresponding radial lock surface (not shown) of the BOP body 602. In at least one embodiment, each of the straight sections comprises a plurality of smaller sections.

Figure 27A:
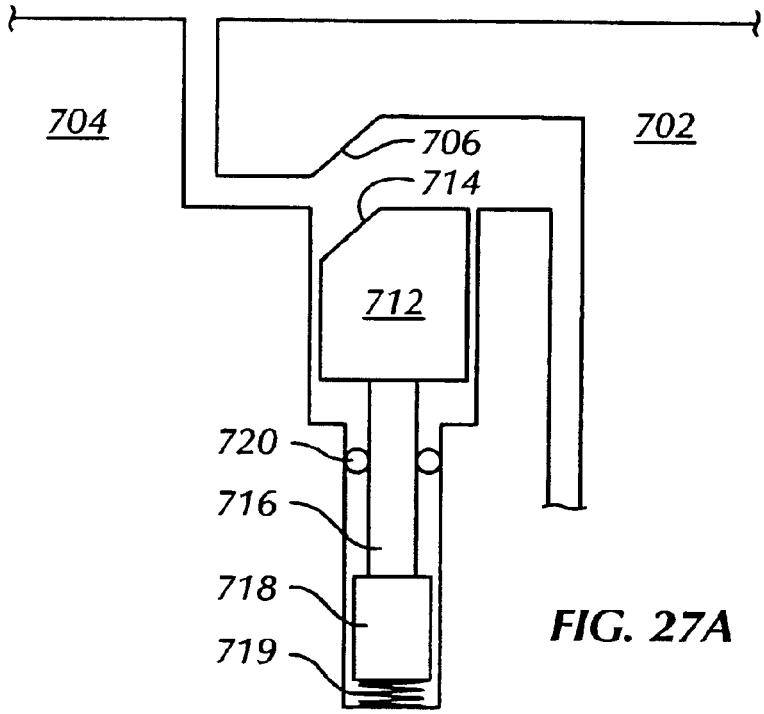
FIG. 27A shows a cross-section of an embodiment of a bonnet latching mechanism in an unlatched position.

Another embodiment of a latching mechanism is shown in FIG. 27A. A bonnet 704 is securely coupled to a BOP body 702 by a latching dog 712 disposed inside the bonnet 704. The latching dog 712 includes a tapered edge 714 that lockingly engages with an angled surface 706 of the BOP body 702 to lock the bonnet 704 with the BOP body 702, even under the high pressure experienced during a blowout.

The angle of the tapered edge 714 may be selected so that the extension of the latching dog 712 will pull the bonnet 704 axially towards the BOP body 702 an into the proper coupled position, in the event it is not in that position when the latching mechanism is engaged. In some embodiments, the taper angle may be a "locking taper." A locking taper is a taper having an angle selected such that the latching dog 714 will not be forced toward a retracted position by pressure that tends to force the bonnet 704 and the BOP body 702 away from each other. In some embodiments, a locking taper has an angle between 3 degrees and 10 degrees. In at least one embodiment, a locking taper is about 6 degrees. Those having ordinary skill in the art will realize that a locking taper may be varied, depending on the particular application.

Figure 27B:
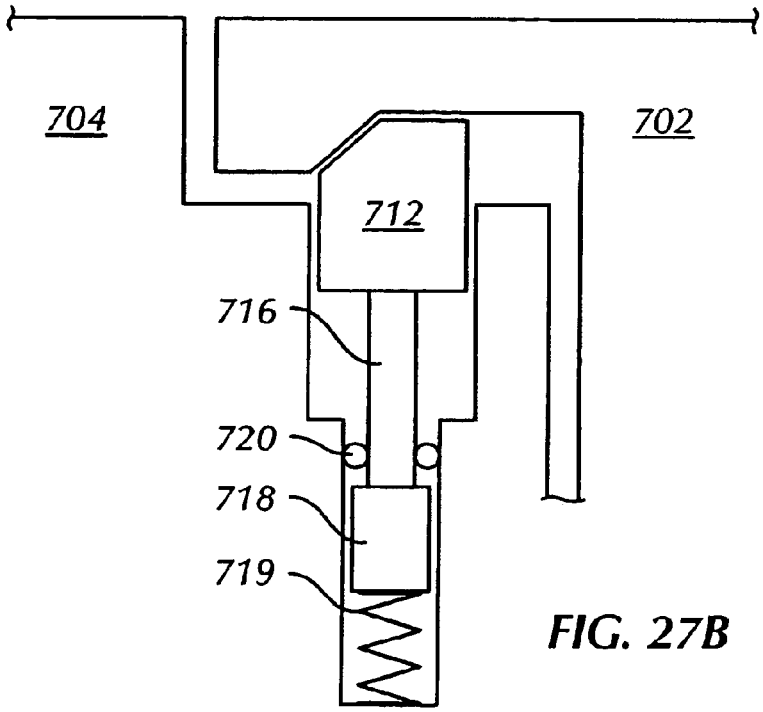
FIG. 27B shown a cross-section of an embodiment of a bonnet latching mechanism in a latched position.

In this embodiment, the latching dog 712 is coupled to a shaft 716 and a piston 718. The actuator may be driven by hydraulic fluid, a pneumatic fluid, a motor, or any other actuation means that is know in the art. Those having skill in the art will be able devise other methods for actuating the latching dog 712. In some embodiments, such as the one shown in FIGS. 27A and 27B, a spring 719 is included to provide upward force that will tend to push the latching dog 712 into locking engagement with the angled surface 706 of the BOP body 702. As shown in FIGS. 27A and 27B, the shaft 716 may be sealed with seals 720 so that hydraulic fluids cannot escape the inside of the bonnet 704 during operation of the latching mechanism.

The embodiment shown in FIGS. 27A and 27B has a latching dog 712 positioned in the bonnet 704 and able to extend into engagement with the BOP body 702. Those having ordinary skill in the art will realize that the latching dogs may also be disposed in a BOP body such that the latching dogs would extend into locking engagement with an angled surface of the bonnet. Further, all of the embodiments described below include a latching mechanism with elements that engage to couple a bonnet and a BOP body. It is expressly within the scope of the invention to have those elements disposed in or on the bonnet to be interchanged with those disposed in or on the BOP body.

The latching dog 712 may be coupled to the shaft 716 by any means known in the art. For example, the shaft 716 may be coupled to the latching dog 712 by a threaded connection. Such a connection would enable the latching dog 712 to be moved in the upward and downward directions.

Figure 28A:
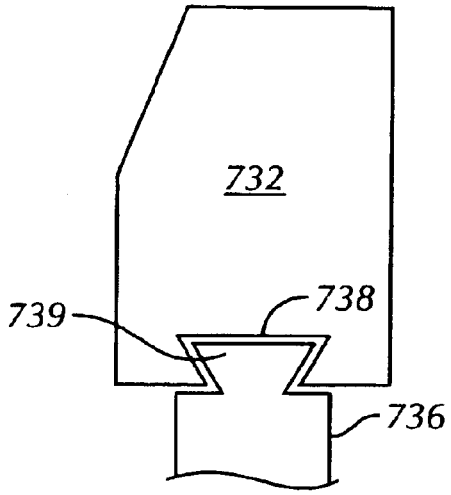
FIG. 28A shows a cross-section of an embodiment of a coupling between a latching dog and a shaft.

FIG. 28A shows another embodiment of a connection between a latching dog 732 and a shaft 736. The shaft 736 includes a generally dovetail-shaped protrusion 739 at its upper end. The dovetail-shaped protrusion 739 is fit into a dovetail-shaped recess 738 in the latching dog 732. The cooperation of the dovetail-shaped protrusion 739 with the dovetail-shaped recess 738 enables the latching dog 732 to be moved both upwardly and downwardly, and it enables the latching dog 732 to "float" so that it may fit better with the tapered edge (706 in FIGS. 27A and 27B) of the BOP body(702 in FIGS. 27A and 27B).

Figure 28B:
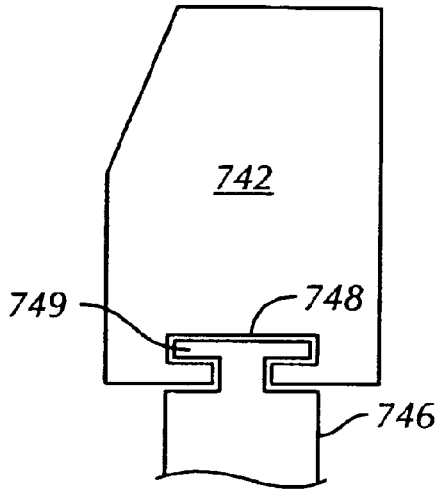
FIG. 28B shows a cross-section of another embodiment of a coupling between a latching dog and a shaft.

FIG. 28B shows another embodiment of a floating coupling between a latching dog 742 and a shaft 746. The latching dog 742 includes a groove 748, and the shaft 746 includes a tongue 749. The engagement of the tongue 749 and the groove 748 creates a "tongue-in-groove" connection between the latching dog 742 and the shaft 746. Those having ordinary skill in the art will be able to devise other couplings between a shaft and a latching dog, without departing from the scope of the present invention.

Figure 29:
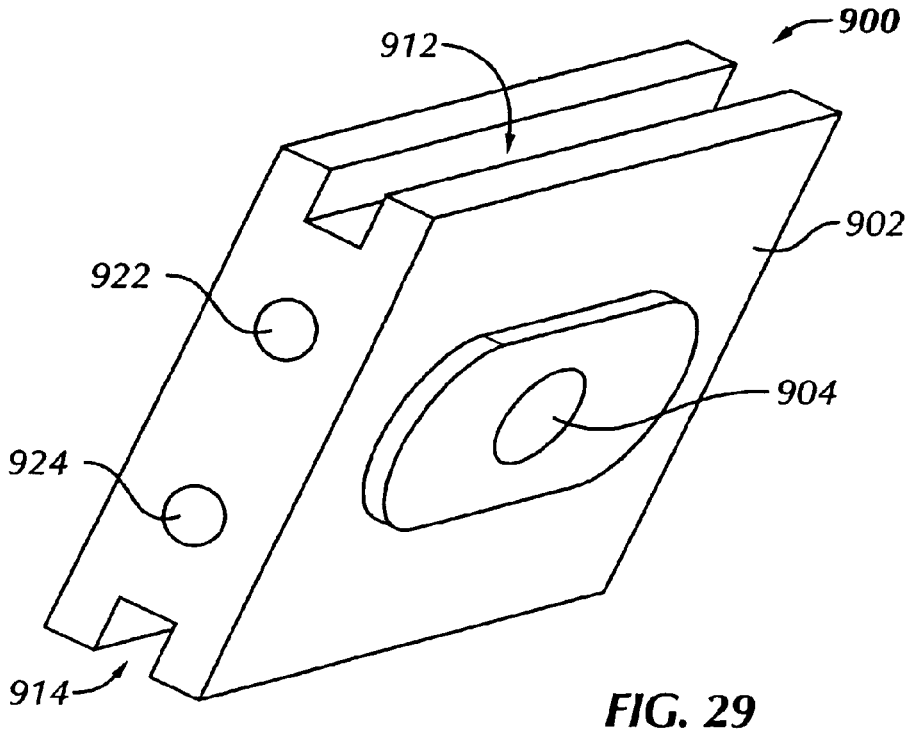
FIG. 29 shows a perspective view of an embodiment of a bonnet door.

FIG. 29 shows an embodiment of a bonnet door 900 that may be used with one or more of the latching mechanisms disclosed herein. The bonnet door 900 has a front face 902 that faces towards the centerline (not shown) of the BOP body (not shown) when the bonnet is coupled to the BOP body (not shown). A hole 904 in the bonnet door 900 enables the ram actuator (not shown) to pass through the bonnet door 900.

The bonnet door 900 has a groove 912 along the length of its top side. The groove 912 provides a location in which latching mechanisms may be positioned. A similar groove 914 extends along the bottom side of the bonnet door 900. A channel 922 extends through the bonnet door 900 proximate the groove 912 in the top side. The channel 922 enables hydraulic or pneumatic fluids to be pumped into the bonnet door 900 to energize the latching mechanisms (not shown) positioned in the groove 912. Also, mechanical devices may be inserted and moved in the channel 922 to enable the movement of latching mechanisms (not shown) in the groove 912. A similar channel 924 is located proximate the lower groove 914.

Figure 30A:
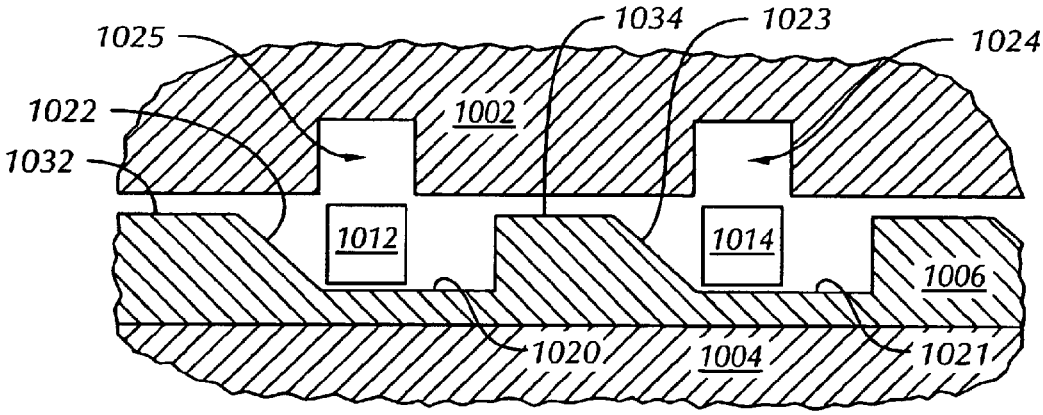
FIG. 30A shows a cross-section of an embodiment of a bonnet latching mechanism in an unlatched position.
Figure 30B:
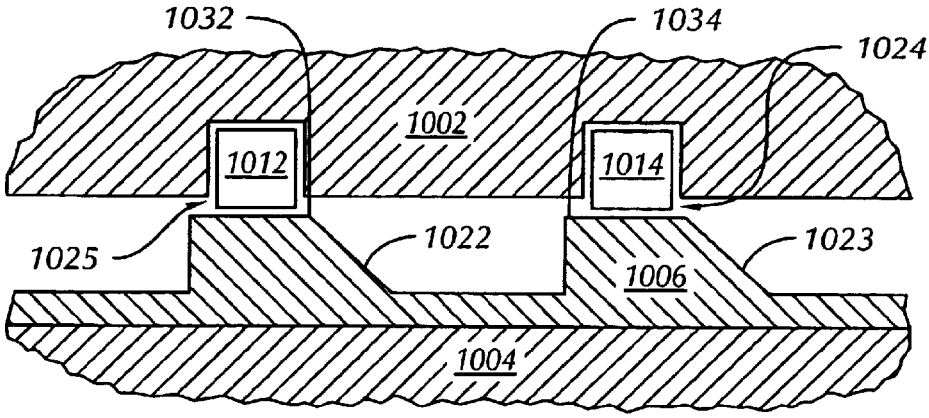
FIG. 30B shown a cross-section of an embodiment of a bonnet latching mechanism in a latched position.

FIGS. 30A and 30B show one embodiment of a mechanical device that may be used to move latching dogs 1012, 1014, positioned inside a bonnet 1004, into engagement with a BOP body 1002. A movable actuator 1006 moves inside the bonnet 1004 to move the latching dogs 1012, 1014 into the engaged position. It is noted that in different embodiments the movable actuator 1006 may move in different ways. For example, in one embodiment, the movable actuator slides. It is also expressly within the scope of this invention to have an actuator on rollers. Those having ordinary skill in the art will be able to devise other ways to facilitate the movement of an actuator.

FIG. 30A shows the latching dogs 1012, 1014 in an unengaged position. The latching dogs 1012, 1014 are located in recessed surfaces 1020, 1021 that enable the latching dogs 1012, 1014 to be positioned within the bonnet 1004. The movable actuator 1006 also includes a plurality of support surfaces 1032, 1034. Inclined surfaces 1022, 1023 are positioned between the recessed surfaces 1020, 1021 and the support surfaces 1032, 1034. As the movable actuator 1006 moves (e.g., to the right in FIG. 30A), the latching dogs 1012, 1014, which are held in place in the bonnet 1004, are pushed upward into recesses 1024, 1025 in the BOP body 1002.

FIG. 30B shows the latching dogs 1012, 1014 in an engaged position. The latching dogs 1012, 1014 have been pushed partially into the BOP body 1002 by the movable actuator 1006. The dogs 1012, 1014 are supported on support surfaces 1032, 1034, and the latching dogs 1012, 1014 extend into recesses 1024, 1025 in the BOP body 1002 to form a locking engagement. The bonnet 1004 may be unlatched by moving the movable actuator 1006 back to its initial position, as shown in FIG. 30A.

Figure 31:
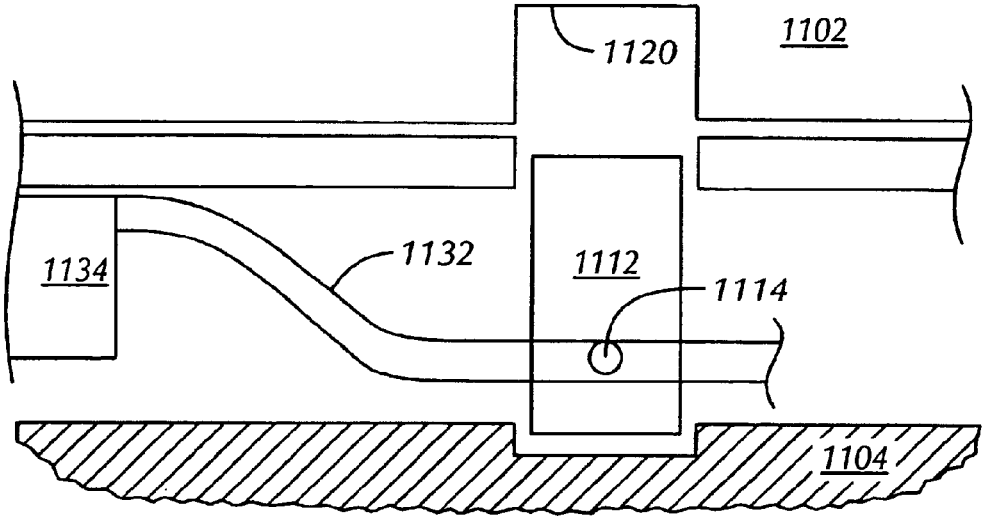
FIG. 31 shows a cross-section of an embodiment of a bonnet latching mechanism in an unlatched position.

FIG. 31 shows another embodiment of a latching mechanism according to the invention. A latching dog 1112 in a bonnet 1104 is connected to a recess track 1132 in a movable actuator 1134 by a pin 1114. As an actuator 1134 moves the rail 1132, the latching dog 1112 is moved upward into a locking engagement with a recess 1120 in the BOP body 1102. By moving the rail 1132 in the opposite direction, the latching dog 1112 returns to the unlatched position. It is noted that the recess track 1132 and the actuator 1134 may form one piece, or they may be formed of separate components that are coupled together.

Figure 32:
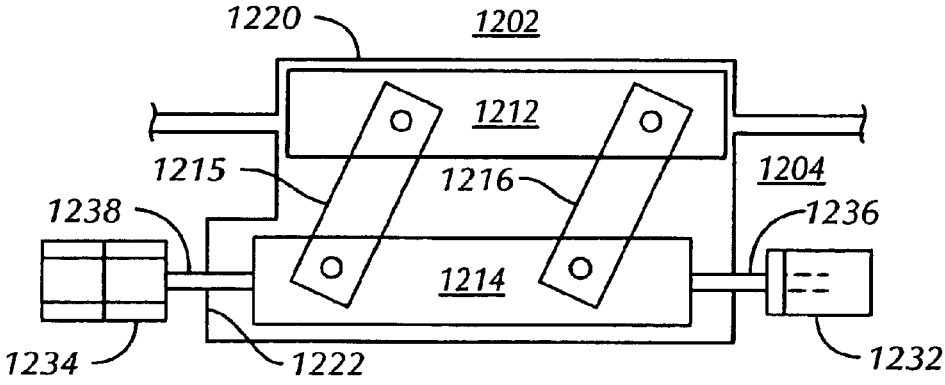
FIG. 32 shown a cross-section of an embodiment of a bonnet latching mechanism in a latched position.

FIG. 32 shows another embodiment of a latching mechanism for coupling a bonnet 1204 to a BOP body 1202 according to the invention. A latching dog 1212 is coupled to a support dog 1214 by two angled bars 1215, 1216. Each angled bar 1215, 1216 is hingedly connected to both the latching dog 1212 and the support dog 1214.

The support dog 1214 is coupled to two linear actuators 1232, 1234 that move the support dog 1214 back and forth. A recess 1222 in the bonnet 1204 enables the support dog 1214 to move side to side, but not up and down. The latching dog 1212 may move up and down, but not side to side. When the support dog 1214 is moved (e.g., to the right in FIG. 32), the angled bars 1215, 1216 push the latching dog 1212 upward and into a locking engagement with a recess 1220 in the BOP body 1202. In some embodiments, the support dog 1214 is moved by only one actuator. Further, in at least one embodiment, the support dog 1214 in moved by manual actuation. Those having skill in the art will be able to devise other methods of actuating the support dog 1214 without departing from the scope of the invention.

Figure 33A:
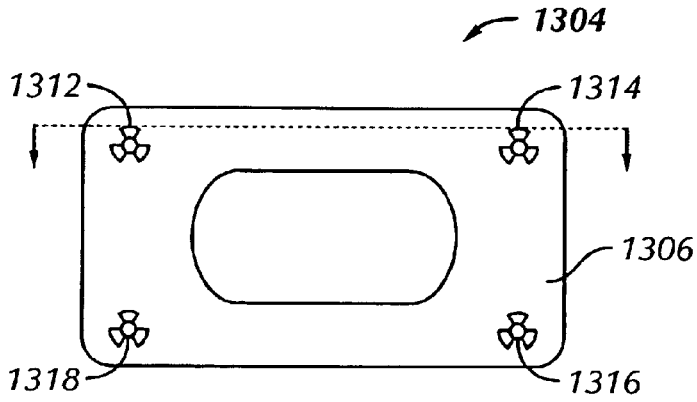
FIG. 33A shows a front view of an embodiment of a bonnet latching mechanism.
Figure 33B:
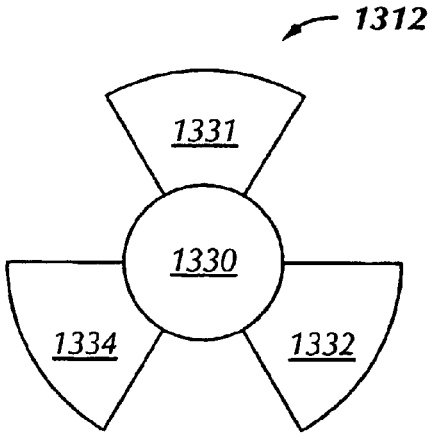
FIG. 33B shows a top view of an embodiment of a stick-in dog.
Figure 33C:
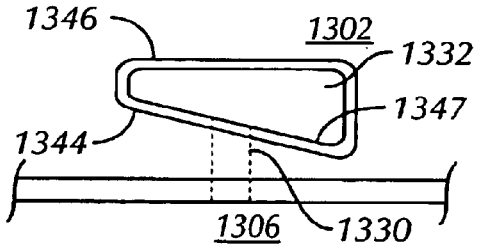
FIG. 33C shows a cross-section of an embodiment of a stick-in dog in a latched position.

Another embodiment of a latching mechanism is shown in FIGS. 33A–33C. FIG. 33A shows an elevation view of the front face of a bonnet door 1306 of a bonnet 1304. The bonnet door 1306 includes four stick-in dogs 1312, 1314, 1316, 1318. While four stick in dogs are shown 1312, 1314, 1316, 1318, the invention is not limited to four. Any number of stick-in dogs may be used without departing from the scope of the invention.

FIG. 33B shows a close-up of a stick-in dog 1312. The stick-in dog 1312 includes three latching members 1332, 1334, 1336 attached circumferentially around a shaft 1330. As shown in FIG. 33C, latching member 1332 is attached to the shaft (shown in dashed lines at 1330) at a distance from the bonnet door 1306.

As the bonnet 1304 is coupled to a BOP body 1302, the stick-in dogs (1312, 1314, 1316, 1318 in FIG. 33A) mate with the BOP body 1302 in slots (1346, for example, is shown in FIG. 33C) that are shaped like the stick-in dogs. For each stick-in dog (1312, for example), a portion of the shaft 1330 and the three latching members 1332, 1334, 1336 are inserted into the BOP body 1302. The stick-in dog 1312 is then rotated so that tapered surfaces on the latching members (1332, 1334, 1336 in FIG. 33B) engage with the angled surfaces interior of the BOP body. For example, in FIG. 33C, latching member 1332 has a tapered surface 1344 that engages with an angled surface 1347 in the BOP body 1302. Because of the angle of the tapered surface 1344 and the angle of the angled surface 1347, the bonnet 1304 is pulled towards the BOP body 1302 as the stick-in dogs are rotated. The bonnet 1304 and the BOP body 1302 may be uncoupled by rotating the stick-in dogs 1312, 1314, 1316, 1318 in the opposite direction.

Figure 34A:
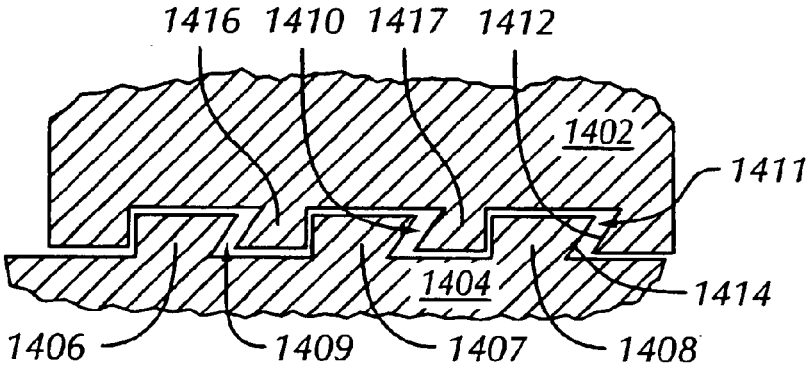
FIG. 34A shows a cross-section of an embodiment of a bonnet latching mechanism in an unlatched position.
Figure 34B:
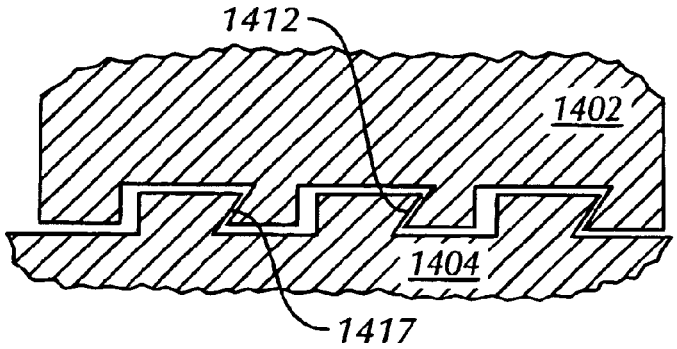
FIG. 34B shown a cross-section of an embodiment of a bonnet latching mechanism in a latched position.

FIGS. 34A and 34B show another latching mechanism in accordance with the invention. A bonnet 1404 includes semi-dovetail protrusions 1406, 1407, 1408 each having one tapered surface (shown generally at 1414). The BOP body 1402 has similar semi-dovetail protrusions 1416, 1417 with opposing tapered surfaces (shown generally at 1412). The semi-dovetail protrusions (1406, 1407, 1408, and 1416, 1417) are spaced so that the protrusions on the bonnet 1406,

1407, 1408 may be inserted into the BOP body 1402 and past the protrusions on the BOP body 1416, 1417, as shown in FIG. 34A. By doing so, the protrusions on the BOP body 1416, 1417 will be extend into the bonnet 1404 as well.

The tapered surfaces 1414 in the bonnet 1404 are opposed to the tapered surfaces 1412 in the BOP body 1402 in such a way that when the protrusions 1416, 1417 in the BOP body 1402 moves relative to the bonnet 1404 (e.g., to the left in FIGS. 34A and 34B), they lockingly engage the bonnet protrusions 1406, 1407, as shown in FIG. 34B. As the tapered surfaces 1412, 1414 are pressed against each other, the BOP body 1402 and the bonnet 1404 are pulled together. It is noted that either of the bonnet 1404 and the BOP body 1402 could provide moving surfaces, allowing the other components to remain stationary.

Figure 35A:
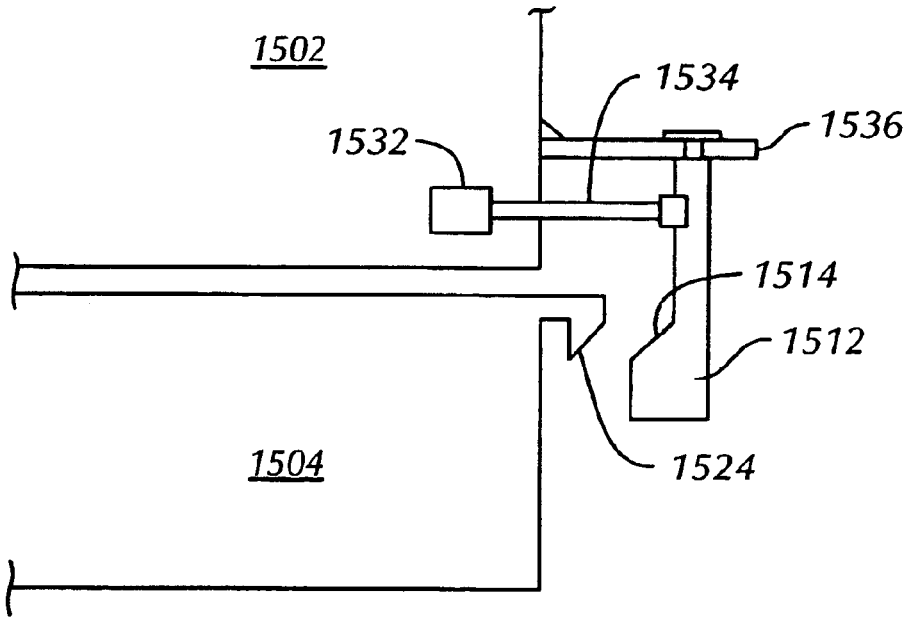
FIG. 35A shows a cross-section of an embodiment of a bonnet latching mechanism in an unlatched position.
Figure 35B:
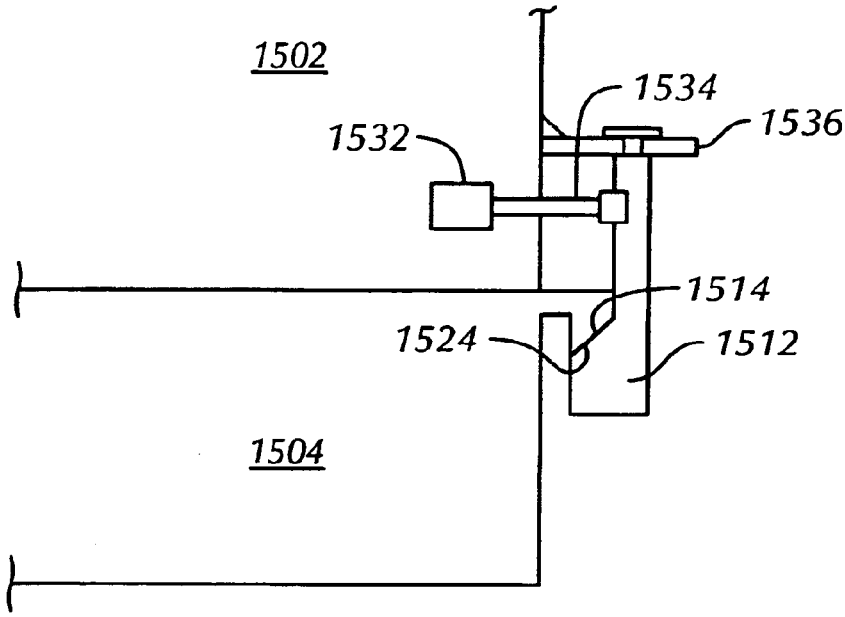
FIG. 35B shown a cross-section of an embodiment of a bonnet latching mechanism in a latched position.

FIGS. 35A and 35B show another embodiment of a latching mechanism in accordance with the invention. In FIG. 35A a latching member 1512 is coupled to the BOP body 1502 by a support member 1536. The latching member 1512 is also coupled to a linear actuator 1532 by a rod 1534.

The latching member 1512 includes a tapered surface 1514 opposed to a tapered surface 1524 of the bonnet 1504, when the bonnet is positioned in a side opening of the BOP body (not shown). To latch the bonnet 1504 to the BOP body 1502, the latching member 1512 is moved closer to the BOP body 1502 so that the tapered surface 1514 on the latching member 1512 contacts the tapered surface 1524 on the bonnet 1504, as shown in FIG. 35B. The latching member 1512 is moved by the actuator 1532, and it slides along the support member 1536. The contact pressure between the tapered surfaces 1514, 1524 pulls the bonnet 1504 closer to the BOP body 1502. The invention in not limited to a linear actuator. For example, in some embodiments, the latching member 1512 is moved by manual actuation. Those having ordinary skill in the art will be able to devise other activation methods that do not depart from the scope of the invention.

Figure 36B:
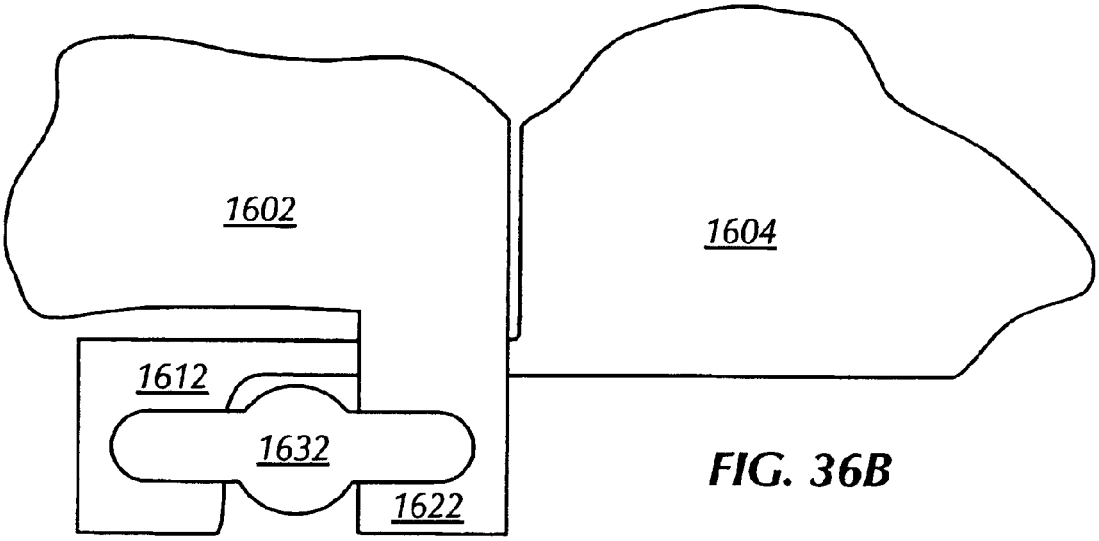
FIG. 36B shows a top view of an embodiment of a bonnet latching mechanism in a latched position.
Figure 36A:
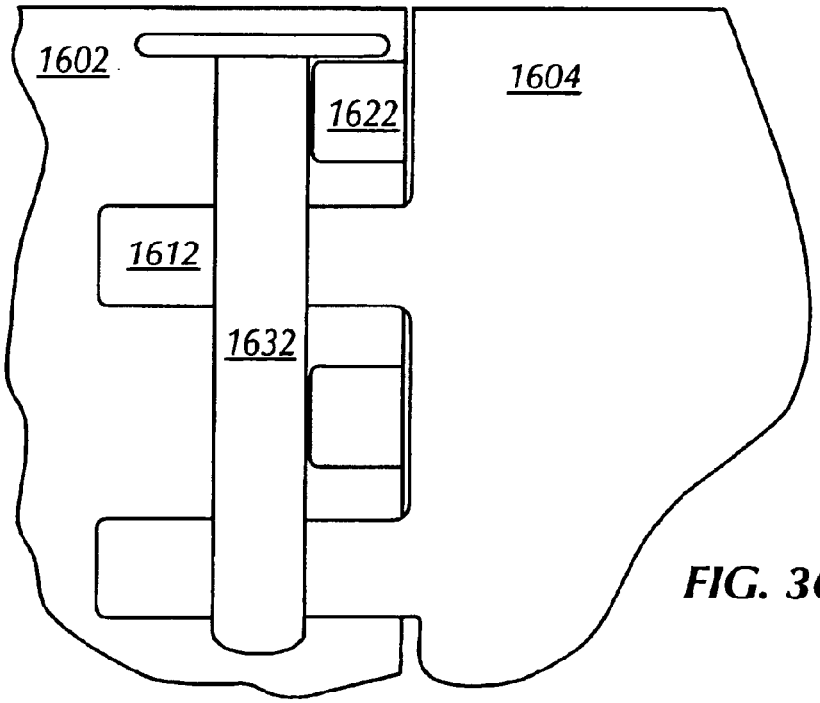
FIG. 36A shows a side view of an embodiment of a bonnet latching mechanism in a latched position.
Figure 36C:
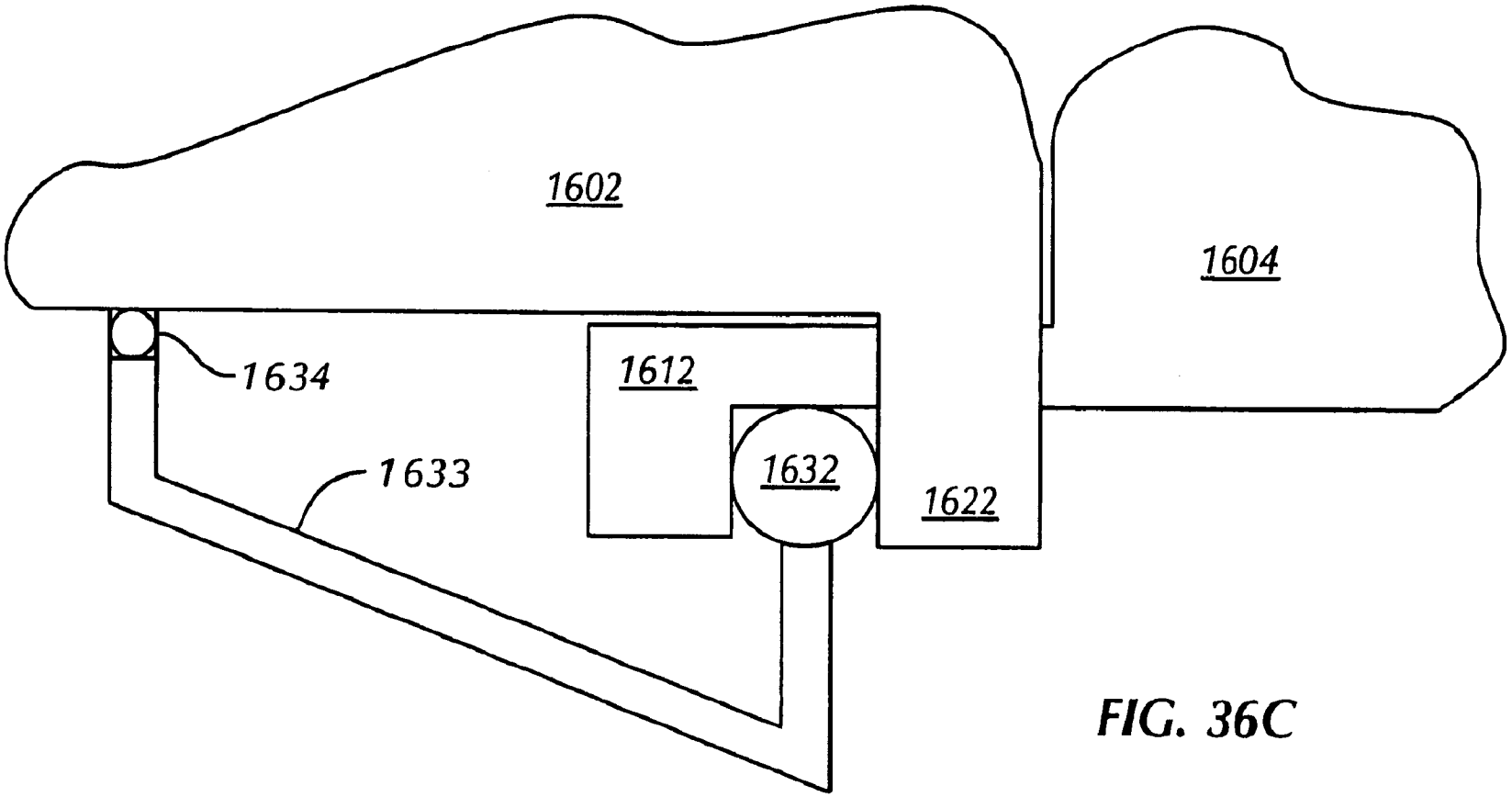
FIG. 36C shows a top view of an embodiment of a bonnet latching mechanism in a latched position.

FIGS. 36A–36C show another embodiment of a latching mechanism at accordance with the invention. FIG. 36A shows a side view of a bonnet 1604 and a BOP body 1602 that are coupled together. The bonnet 1604 includes a plurality of latching extensions (e.g., latching extension 1612 in FIG. 36A) that extend along the side of the BOP body 1602.

The BOP body 1602 includes latching dogs (e.g., BOP latching dog 1622) that extend away from the BOP body 1602. The BOP latching dogs (e.g., BOP latching dog 1622) are staggered with the bonnet latching extensions (e.g., 1612) so that they pass each other when the bonnet 1604 and the BOP body 1602 are coupled. A latching bar 1632 would then pass in between the dogs (e.g., bonnet dog 1612 and BOP dog 1622) to lock the bonnet 1602 in place.

FIG. 36B shows a top view of the latching bar 1632 positioned between the bonnet latching dog 1612 and the BOP latching dog 1622. Any forces that would tend to separate the bonnet 1604 and the BOP body 1602 would be absorbed in sheer by the latching bar 1632.

FIG. 36C shows a top view of an embodiment of a latching mechanism. A latching bar 1632 is hingedly coupled to the BOP body by a swing member 1633 and a hinge 1634. The latching bar 1632 may be pivoted into a position between the bonnet latching dogs (e.g., latching dog 1612) and the BOP latching dogs (e.g., latching dog 1622). In this position, the latching bar may resist any force that would tend to uncouple the bonnet 1604 and the BOP body 1602.

Figure 37A:
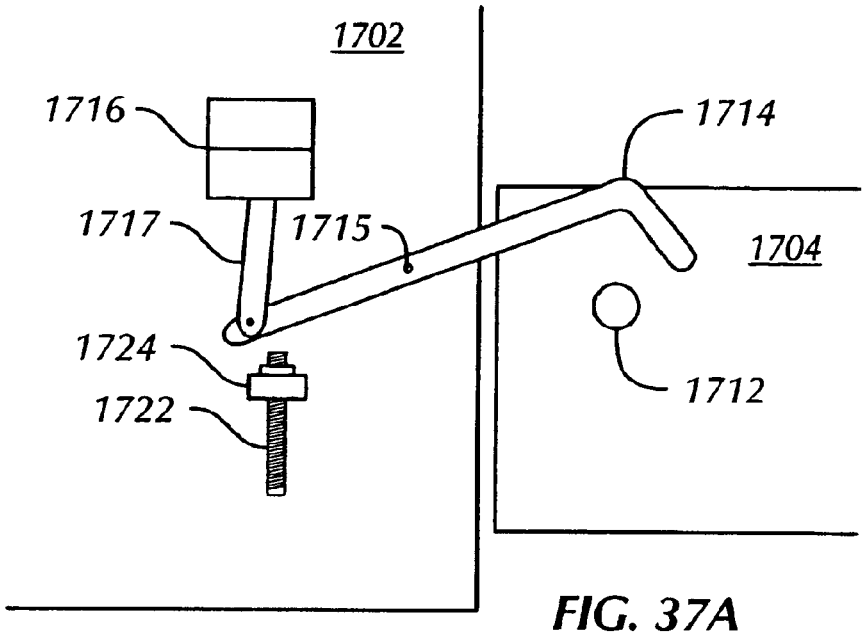
FIG. 37A shows a cross-section of an embodiment of a bonnet latching mechanism in an unlatched position.
Figure 37B:
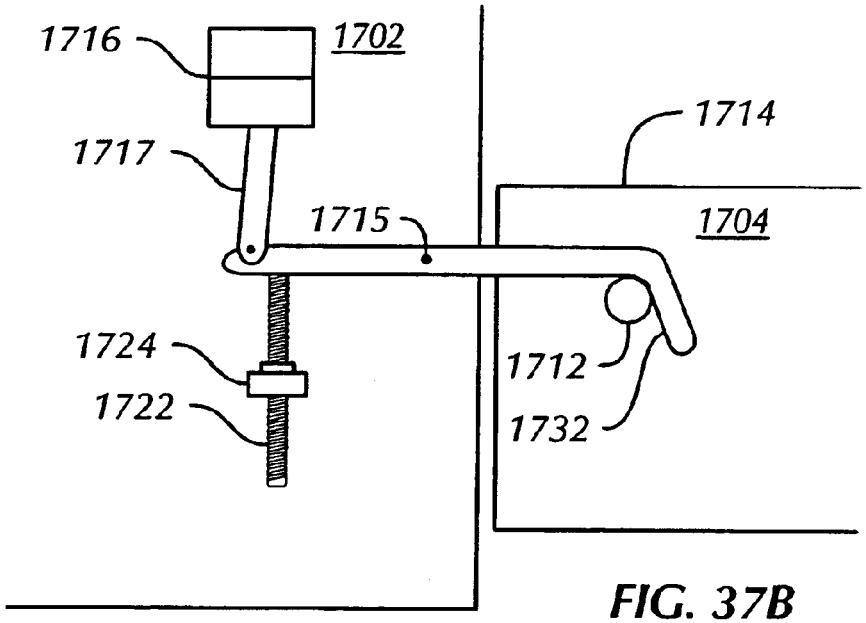
FIG. 37B shown a cross-section of an embodiment of a bonnet latching mechanism in a latched position.

FIGS. 37A and 37B show another embodiment of a latching member according to the invention. FIG. 37A shows a pivot member 1714 in an unlatched position. The pivot member is connected to the BOP body 1702 by a hinge 1715 so that the pivot member 1714 may pivot. A linear actuator 1716 is coupled to the pivot member 1714 by a actuation member 1717. The bonnet 1704 includes a latching dog 1712, about which the pivot member may 1714 latch.

FIG. 37B shows the pivot member 1714 in a latched position. A latching surface 1732 of the pivot member 1714 latches around the latching dog 1712 to resist forces that tend to separate the BOP body 1702 and the bonnet 1704. The latching surface may be tapered to ease the latching process. In some embodiments, the latching surface 1732 forms a locking taper.

In some embodiments, such as the one shown in FIG. 37A, the BOP body 1702 includes a mechanical stop. A screw 1722 is maintained in place by a stop 1724. The position of the screw 1722 may be adjusted so that the pivot member 1714 may be unlatched when desired. When latched, the screw 1722 may be positioned so that the pivot member 1714 may not move out of latching contact with the latching dog 1712 on the bonnet 1704.

Other actuation devices may be used without departing from the scope of the invention. For example, the pivot member 1714 may be pivoted by manual activation. The method of actuation is not intended to limit the invention.

Advantageously, one or more embodiments of the present invention enable a bonnet to be securely coupled to a BOP body by a latching mechanism that may be unlatched in a relatively short period of time. This enables easy inspection and replacement of ram blocks, seals, and other component parts of a BOP.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A bonnet lock mechanism for a blowout preventer comprising:

a radial lock;

a radial lock displacement device; and at least one lock actuator operatively coupled to the radial lock displacement device, wherein the radial lock is comprised of straight section, and wherein the radial lock displacement device is adapted to radially displace the radial lock to form a locking engagement between a bonnet and a body of the blowout preventer.

2. A bonnet lock mechanism for a blowout preventer comprising:

an angled surface disposed in the blowout preventer;

a latching dog having a tapered surface disposed in the bonnet; and a lock actuator operatively coupled to the latching dog, wherein the lock actuator is adapted to move the latching dog such that the latching dog is in locking engagement with the angled surface of the blowout preventer.

3. The bonnet lock mechanism of claim 2, wherein the latching dog comprises a corresponding dovetail-shaped recess, and wherein the lock actuator is coupled to the latching dog by a shaft having a generally dovetail-shaped protrusion that is coupled to the generally dovetail-shaped recess in the latching dog.

* * * * *